United States Patent [19]

Mooney

[11] 3,989,370

[45] Nov. 2, 1976

[54] ADAPTIVE FUSER CONTROLLER

[75] Inventor: Thomas J. Mooney, Fairport, N.Y.

[73] Assignee: Xerox Corporation, Stamford, Conn.

[22] Filed: Apr. 1, 1975

[21] Appl. No.: 564,173

[52] U.S. Cl. ..... 355/14; 219/216; 355/3 R

[51] Int. Cl.[2] ..... G03G 15/00

[58] Field of Search ..... 355/14, 17, 3 FU; 219/216, 488, 492

[56] References Cited

UNITED STATES PATENTS

| | | | |
|---|---|---|---|
| 3,398,259 | 8/1968 | Tregay et al. | 355/3 FU |
| 3,745,304 | 7/1973 | Hutner | 219/216 |
| 3,790,747 | 2/1974 | Klavsons et al. | 219/216 |

*Primary Examiner*—R. L. Moses

*Attorney, Agent, or Firm*—Paul Weinstein; Clarence A. Green; James J. Ralabate

[57] ABSTRACT

Apparatus and method for minimizing heating effects and reducing power surges in the fuser element of a copier/duplicator by providing a reduce power, soft turn-on operation during single copy machine cycles followed by a full power turn-on at entry of the copy paper into the fusing station. An adaptive fusing circuit is disclosed so that each of multiple modes of machine operation are properly timed with the fuser soft power-on and full power turn-on features. Available machine modes of operation include chain feeding and large document copying using both a fixed and a movable optical scanning system.

25 Claims, 22 Drawing Figures

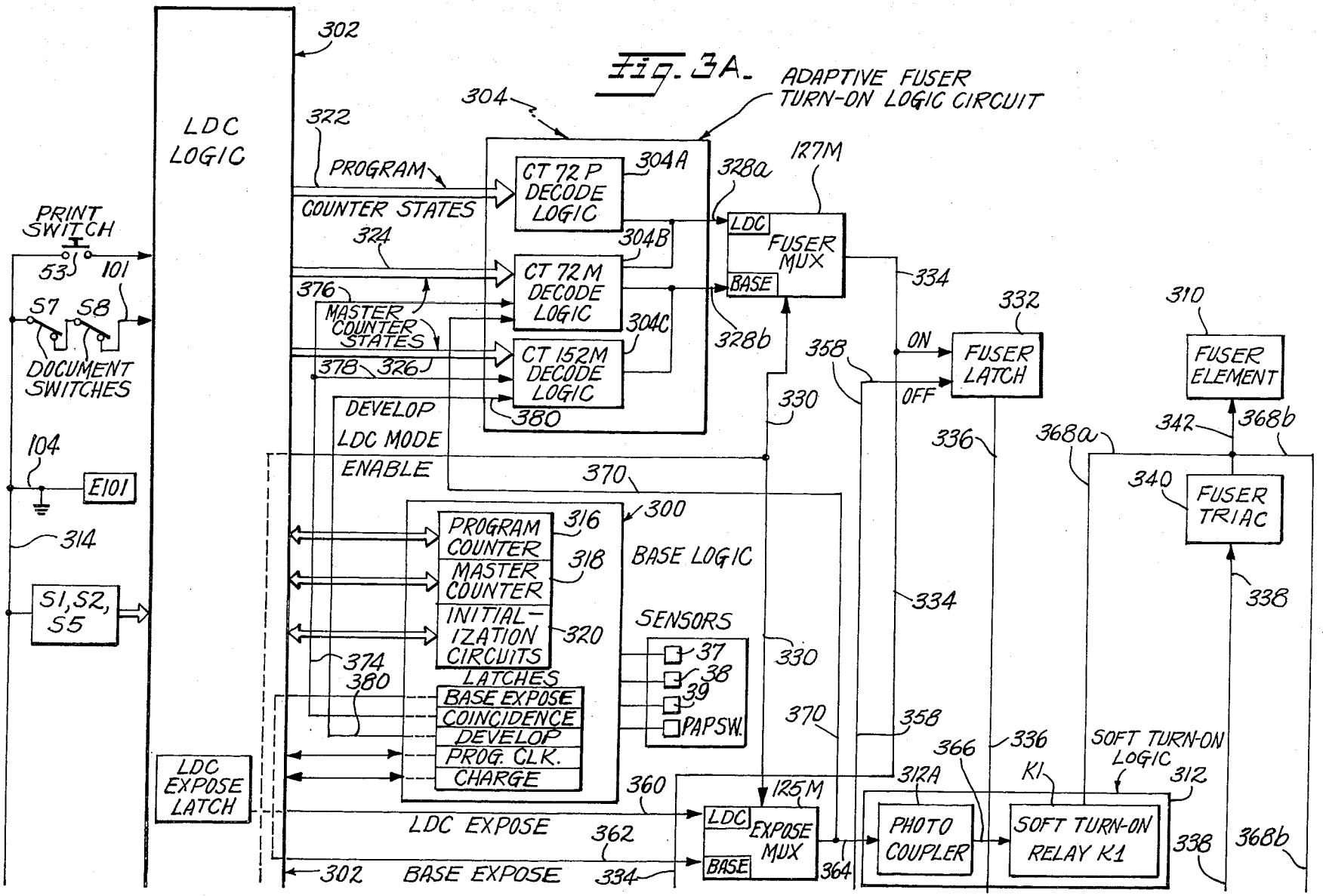
FIG. 3A.
ADAPTIVE FUSER TURN-ON LOGIC CIRCUIT
FUSER ELEMENT
FUSER TRIAC
FUSER LATCH
FUSER MUX
LDC
BASE
CT 72 P DECODE LOGIC
CT 72 M DECODE LOGIC
CT 152 M DECODE LOGIC
PROGRAM COUNTER STATES
MASTER COUNTER STATES
DEVELOP
LDC MODE ENABLE
BASE LOGIC
PROGRAM COUNTER
MASTER COUNTER
INITIAL-IZATION CIRCUITS
LATCHES
BASE EXPOSE
COINCIDENCE
DEVELOP
PROG. CLK.
CHARGE
SENSORS
PAPSW.
EXPOSE MUX
LDC EXPOSE
BASE EXPOSE
LDC EXPOSE LATCH
LDC LOGIC
PHOTO COUPLER
SOFT TURN-ON LOGIC
SOFT TURN-ON RELAY K1
K1
ON
OFF
PRINT SWITCH
DOCUMENT SWITCHES
E101
S1, S2, S5

| | | |
|---|---|---|
| Fig. 8. | Fig. 7. | Fig. 4. |
| Fig. 9. | Fig. 10. | Fig. 11. |
| Fig. 12. | Fig. 13. | Fig. 14. |

| | |
|---|---|
| Fig. 3A. | Fig. 3B. |

00
01
215
a
b
c
d
360
220
242
213
ONE SHOT
Q̄
Q
S̄ LDC EXPOSURE LATCH
D
Q
264
263
246
283
284
299
362
LD20a
342
330
LD2
LD3
LD4
LD5
LD7
01

DONE LATCH MR
S
D
Q
04
330
362
221
222
284a
111
113
06
09
010
012
013
014
015
016
462
464
121
215
231
281
217
130
460
466
LD20a
342
01

U74
+18V.DC
366
EXP. MUX
370
U67
U71
B
MAIN DRIVE MPX
FUSER MPX
334
168
CHARGE MPX
LDC ONE SHOT CLR
LDC
LDC EXPOF
DEV SET LDC
LDC 16 + COIN RESET
LDC MAS CTR CLR
HOME+L
PRW INIT+L
141 DISABLE
LDC EXT SHUT DN
366
165
EXP MUX
125M
2:1 EXPOSE MUX
126M
2:1 MAIN DRIVE MUX
127M
2:1 FUSER MUX
128M
2:1 CHARGE MUX
A
B
C
06
07
08
09
010
012
013
014
015
016
334
LDC EXPOF
EXPOF
+5V.DC
328a
328b
LD16
330
04
360
362
370
328b
328a
362
06
09
010
012
013
014
015
016

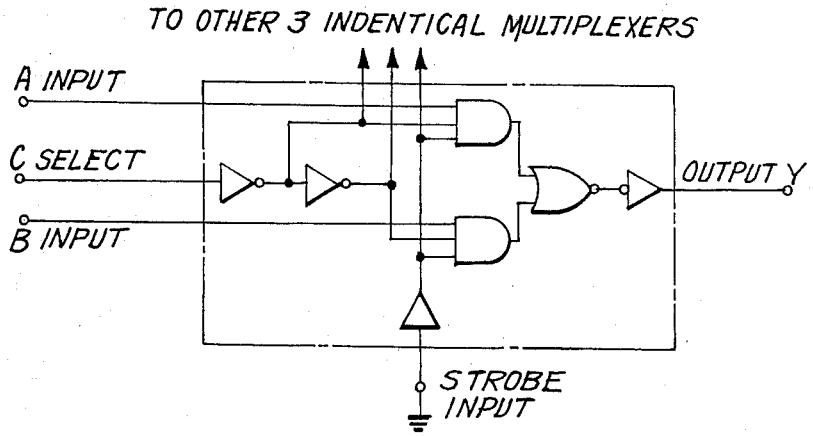

| TRUTH TABLE WITH STROBE GROUNDED | | | |
|---|---|---|---|
| C | A | B | Y |
| H | X | H | H |
| H | X | L | L |
| L | H | X | H |
| L | L | X | L |

X=DON'T CARE (REF.) TEXAS INSTRUMENTS QUAD DATA MUX TYPE SN74157 OR EQUIVALENT

Fig. 16A.

Fig. 16D.

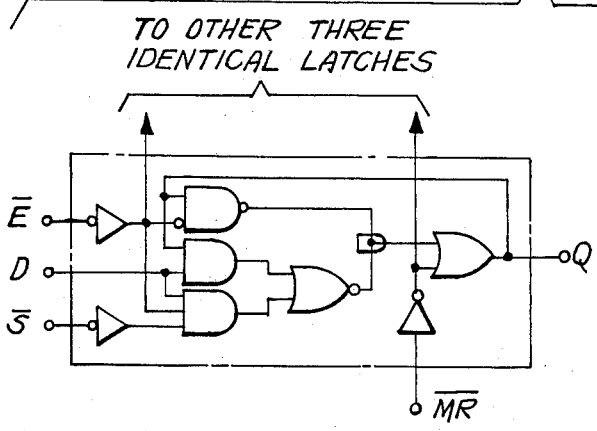

(REF.) FAIRCHILD OR MOTOROLA QUAD LATCH TYPE TTL/MSI 9314 OR EQUIVALENT

| TRUTH TABLE | | | | | |
|---|---|---|---|---|---|
| | INPUT | | | | OUTPUT |
| OPERATION | $\overline{MR}$ | $\overline{E}$ | $\overline{S}$ | D | $Q_n$ |
| D MODE | 1 | 0 | 0 | 0 | 0 |
| | 1 | 0 | 0 | 1 | 1 |
| | 1 | 1 | X | X | $Q_{n-1}$ |
| R/S MODE | 1 | 0 | 0 | 0 | 0 |
| | 1 | 0 | 0 | 1 | 1 |
| | 1 | 0 | 1 | 0 | 0 |
| | 1 | 0 | 1 | 1 | $Q_{n-1}$ |
| | 1 | 1 | X | X | $Q_{n-1}$ |
| DEVICE RESET | 0 | X | X | X | 0 |

| AND | OR | A B | X |
|---|---|---|---|
| 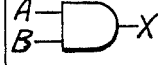 | 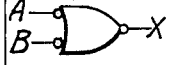 | H H | H |
| | | H L | L |
| | | L H | L |
| | | L L | L |

Fig. 16B.

| NAND | NOR | A B | X |
|---|---|---|---|
| 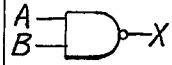 | 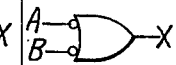 | H H | L |
| | | H L | H |
| | | L H | H |
| | | L L | H |

Fig. 16C.

ADAPTIVE FUSER CONTROLLER

CROSS REFERENCE TO RELATED APPLICATIONS

Reference is made to the following prior disclosures in which subject matter relating to the basic mechanical and electrical features of copier/duplicators having fixed and movable optical systems is disclosed as well as the overall operating modes of copier/duplicators having large document copying capabilities: Ser. No. 284,687 filed Aug. 29, 1972 (now abandoned) and continuation application Ser. No. 367,996, filed June 7, 1973, now U.S. Pat. No. 3,900,258; Ser. No. 393,546, filed Aug. 31, 1973 (now abandoned) and continuation application in the name of L. R. Sohm entitled "Dual Mode Control Logic For A Multi-Mode Copier/Duplicator" filed in Nov., 1974 (D/73383C). Reference is also made to concurrently filed applications in the name of W. L. Valentine entitled "Chain Feed Control Logic For A Multi-Mode Copier/Duplicator" U.S. Pat. application Ser. No. 564,172 and in the name of W. L. Valentine entitled "Cycle-Out Control Logic In A Multi-Mode Copier/Duplicator," both applications assigned to the same assignee as the instant invention.

BACKGROUND OF THE INVENTION

1. Field of the Invention

The invention is in the field of photocopy machines and copy/duplicator machines which utilize fusing means to fix toner particles upon copy paper passing therethrough. The invention particular relates to logic circuitry adapted to control the turn-on and turn-off of the fusing element at appropriate times in relation to various machine modes of operation.

2. Description of the Prior Art

Over heating of the fuser station in copier/duplicator machines has long been a problem in the prior art, and many control circuits have been developed to maintain the temperature of the fuser station within predetermined limits. Particular heat problems arise in fusing stations because of the necessity to maintain a relatively high temperature to achieve proper fusing or fixing of the toner particles onto the copy paper while, at the same time requiring that the overall temperature within the fusing station be maintained relatively low so that feed rollers do not pick-up toner particles and produce "ghost" images. It is also important to maintain the temperature of fuser station itself within a finite temperature range to achieve uniformity of toner fusion on the copy paper. Control circuits to achieve such ends are illustrated in Lawes et al., U.S. Pat. No. 3,505,497 and Traister U.S. Pat. No. 3,735,092 wherein various warm-up time periods are utilized and finite temperature ranges are maintained by the use of thermostats, thermistors and the like. It has also been the practice in the prior art to control heating and minimize power to the fuser by triggering the fuser only upon the approach of the copy paper to the fusing station as illustrated by the Mindell et al. U.S. Pat. No. 3,219,794. As indicated by the above patents, full power fuser turn-on voltages are utilized to control the temperature by regulating the time interval at which the voltage is applied. Alternate approaches however, utilize a variable voltage to the fuser element in attempting to optimize fuser operation. For example, applying an initial high voltage to the heating unit to achieve a fast warm-up is shown in the Crumrine et al. U.S. Pat. No. 2,852,651; varying the heating temperature as a function of the copy paper travel speed is taught by Hopkins U.S. Pat. No. 3,588,445; and providing a plurality of different heating levels within the fuser is shown by Hutner U.S. Pat. No. 3,745,304.

While the various control circuits of the prior art help to reduce over-heating, none of these techniques provide an adaptive fuser control circuit for regulating fuser timing operations with respect to different modes of the copier/duplicator operation. Such multiple mode copier/duplicator machines may utilize, for example, both fixed and movable optical system and have large document copying capabilities (18 × -inches) as well as chain feed and multiple copy modes. An example of such machines is described in detail in copending applications, Ser. No. 367,996, filed June 7, 1973, and Ser. No. 528,163 filed Nov. 29, 1974, (D/73383C). In machines which operate in both chain feeding and large document copying (LDC) modes, it is often a problem to control the fusing element to achieve the proper fusing temperatures and yet prevent overheating and power surges. In these multiple mode machines, it is desirable to control the full power fuser turn-on at an appropriate time with respect to each separate mode of operation of the copier/duplicator.

Additionally, when the large document copying mode is used, it is desirable to regulate the fuser element in relation to the size of the copy paper employed.

In the large document mode of operation, an additional input power surge problem occurs in systems utilizing a zero to full power fuser turn-on such as that shown in the aforementioned Mindell patent. For example, current surges associated with 1150 watt fusers can typically run to 100 amps and thus cause power supply fluctuations and transients which may lead to pole slippage in the drive motors. Drive motor slippage in turn leads to poor copy quality as large document feeding modes typically have exposuring, development, transfer and fusing operations being conducted simultaneously. In effect, the copy paper is large enough so that parts of the paper are still being exposed, developed and transferred when the leading edge of the copy paper reaches the fusing station and full power to the fuser is required.

SUMMARY OF THE INVENTION

It is an object of the instant invention to overcome the disadvantages of the prior art by providing an adaptive control logic circuit for operating the fuser element of a copier/duplicator having multiple modes of operation.

It is another object of the invention to provide a partial power or Soft turn-on feature during copier/duplicator cycles for the different modes of operation of the copier/duplicator so as to achieve reduced internal heat rise and input power surges, thereby improving copy quality.

It is a further object of the invention to provide a partial or Soft turn-on fuser in combination with a full power turn-on fuser for all single copy modes of operation of a copier/duplicator machine.

Another object of the invention is to provide a control circuit in which a combination of low and high power fuser operation is utilized to assure adequate preheating of the fuser element, and subsequently, at the precise moment proper fusing temperature and stability.

It is another object of the invention to delay full power fuser energizing until the image-bearing copy paper is a very short distance from the fusing element, thus eliminating excessive heat buildup resulting from too long a fuser energizing period.

It is further objective of the invention to provide a control circuit in which an independent precise time base is used to control the turn off time of the fuser element.

Another object of the invention is to provide a fuser Soft turn-on and full power turn-on feature in a copier/-duplicator machine having multiple modes of operation, and to provide an adaptive control circuit to optimize the operation of the fuser element during different modes of copier/duplicator operation.

Yet another object of the invention is to provide an adaptive fuser controller which is responsive to various copy paper sizes employed in the copier/duplicator.

Yet another object of the invention is to provide an adaptive fuser controller for a copier/duplicator which may be utilized in a large document mode of operation for preventing input power surges.

Another object of the invention is to provide an adaptive fuser controller which regulates the turn-on and turn-off of the fusing element in a copier/duplicator provided with both a fixed and movable optical scanning system.

Yet another object of the invention is to provide an adaptive fuser controller for minimizing the heat accumulated within the fusing station to prevent toner offsetting during large document copying, chain feeding, multiple copy making as well as single copy making operations of a copier/duplicator machine.

The invention pertains to an adaptive fuser control circuit for providing a Soft turn-on as well as full power turn-on of the fuser synchronized to various different modes of operation of a copier/duplicator machine. The copier/duplicator is provided with a large document copy mode of operation, a chain feed mode of operation, multiple copy mode of operation as well as a conventional single copy mode of operation. The adaptive fuser control circuit is responsive to the various modes of operation to control the fuser element so as to provide an overall reduced heating effect which is yet sufficient to achieve proper fusing. The adaptive fuser controller comprising a Soft turn-on circuit which provides a relatively low power turn-on of the fuser element during exposure of the original document. Depending upon the particular mode of operation of a copier/duplicator, full power turn-on is provided at distinct time periods as determined by master and program counters coupled to fuser turn-on logic. Full power turn-on is achieved slightly before the leading edge of the copy paper crosses the fuser element centerline. Power turn-off is achieved shortly after the trailing edge of the copy paper crosses the fuser element centerline irrespective of the length of the copy paper employed. Turn-off logic circuitry is coupled to a separate fuser counter and is responsive to the operational mode of the copier/duplicator so as to turn off the fuser element at the appropriate time.

BRIEF DESCRIPTION OF THE DRAWINGS

Other objects and features of the invention will become more readily understood from the following detailed description when read in conjunction with the accompaning drawings, in which like reference numerals designate like parts throughout the figures thereof, and wherein:

FIG. 3 illustrates the arrangement of FIGS. 3A and 3B to form the block diagram.

FIGS. 3A–3B show a block diagram of the adaptive fuser controller and its interconnection to the copier/-duplicator of FIGS. 1 and 2;

FIGS. 6–14 show the detailed logic diagram of the adaptive fuser controller of the instant invention and its interconnection to the copier/duplicator;

FIG. 15 illustrates the arrangement of FIGS. 6–14 to form the detailed logic diagram; and FIGS. 16A–16D illustrate circuit details and truth tables associated with key logic elements of the instant invention.

DETAILED DESCRIPTION OF THE PREFERRED EMBODIMENT

1. Mechanical Overview of the Multi-Mode Copier/Duplicator

Figure 1:
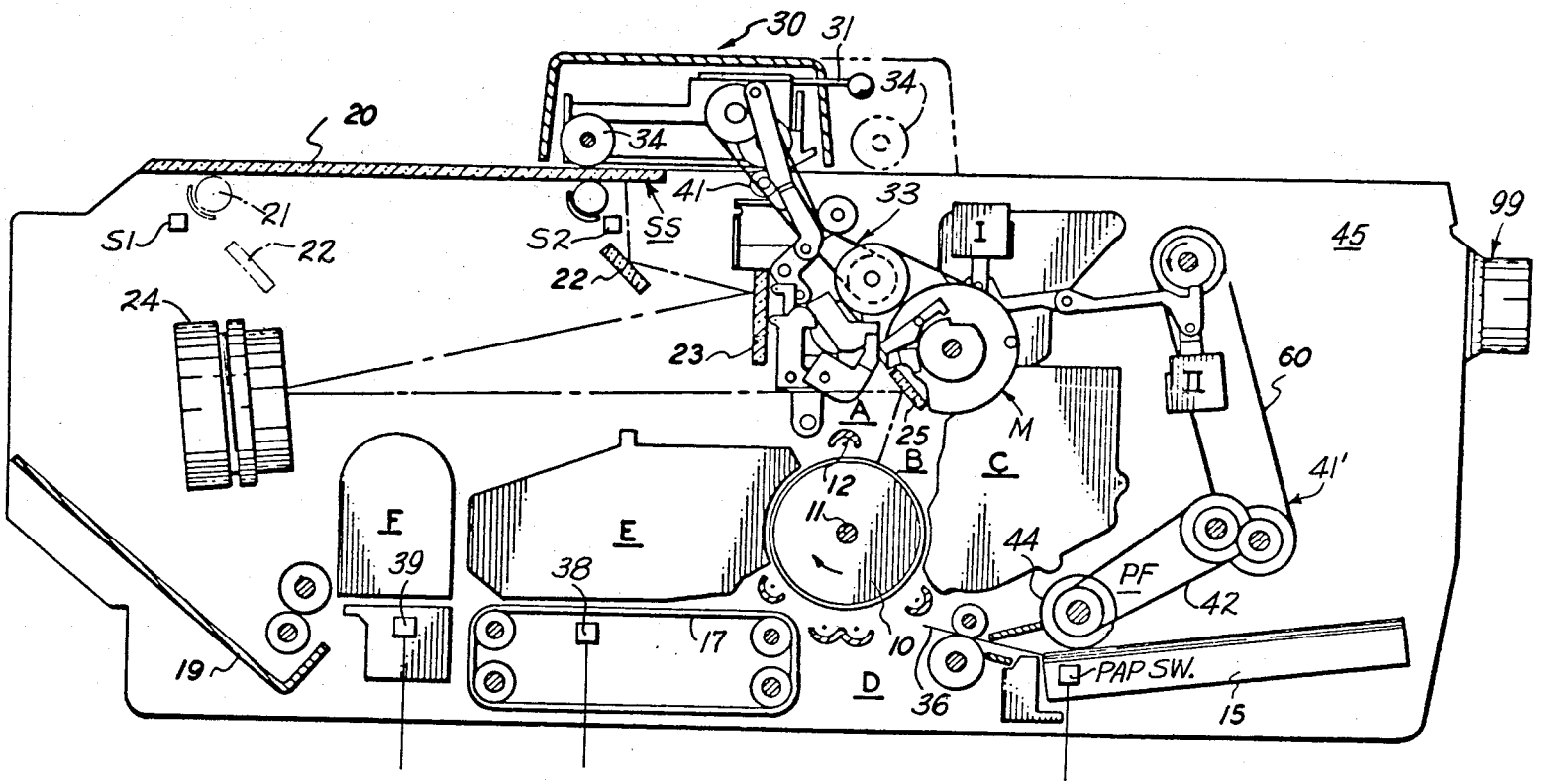
FIG. 1 is a schematic side view of a copier/duplicator in which the adaptive controller of the instant invention may be utilized.

The control circuitry of the present invention will be described in the context of a xerographic copier/duplicator machine of a specific design. However, it should be noted from the outset that although the description is in the context of the xerographic machine, the scope of the present invention is not limited to the xerographic machine. Clearly as will be evident from the following description, the principles of the present invention can be applied to other types of machines having similar operational requirements. Now referring to the drawings, as shown in FIG. 1, a xerographic copier/duplicator machine typically includes various elements for implementing xerographic steps. It comprises a drum 10 that may be driven clockwise about an axis 11. The drum includes a photosensitive insulating layer surface 12 around the periphery of which various controlled elements are situated; namely, charging station A, imagewise exposing station B, developing station C, image transfer station D, cleaning station E, and fusing station F, etc., for effecting the usual steps involved in making xerographic copies. The machine may be further provided with a suitable feeding means PF for feeding copy sheets of paper from a paper supply in a cassette 15 and a suitable paper transfer means 17 for transferring the imaged paper onto the fusing station F where the toner image is fused onto the paper and then feed out to a suitable receptacle means 19.

The xerographic copier/duplicator machine may be designed to operate in different modes. In a first, or BASE Mode, conventional documents up to a certain size are copied and in a second, or LDC Mode, larger size documents are processed. For example, in the BASE Mode, the machine is designed to employ a moving optical scanning arrangement 21–24 to scan a stationary original placed on a platen 20 in making copies up to 14 inches in length and 8.5 inches in width.

In the LDC Mode, the scanning arrangement is held at a stationary position, and the document original is moved past a scanning station SS. In the LDC Mode, document originals up to 14 by 18 inches may be copied.

Figure 2:
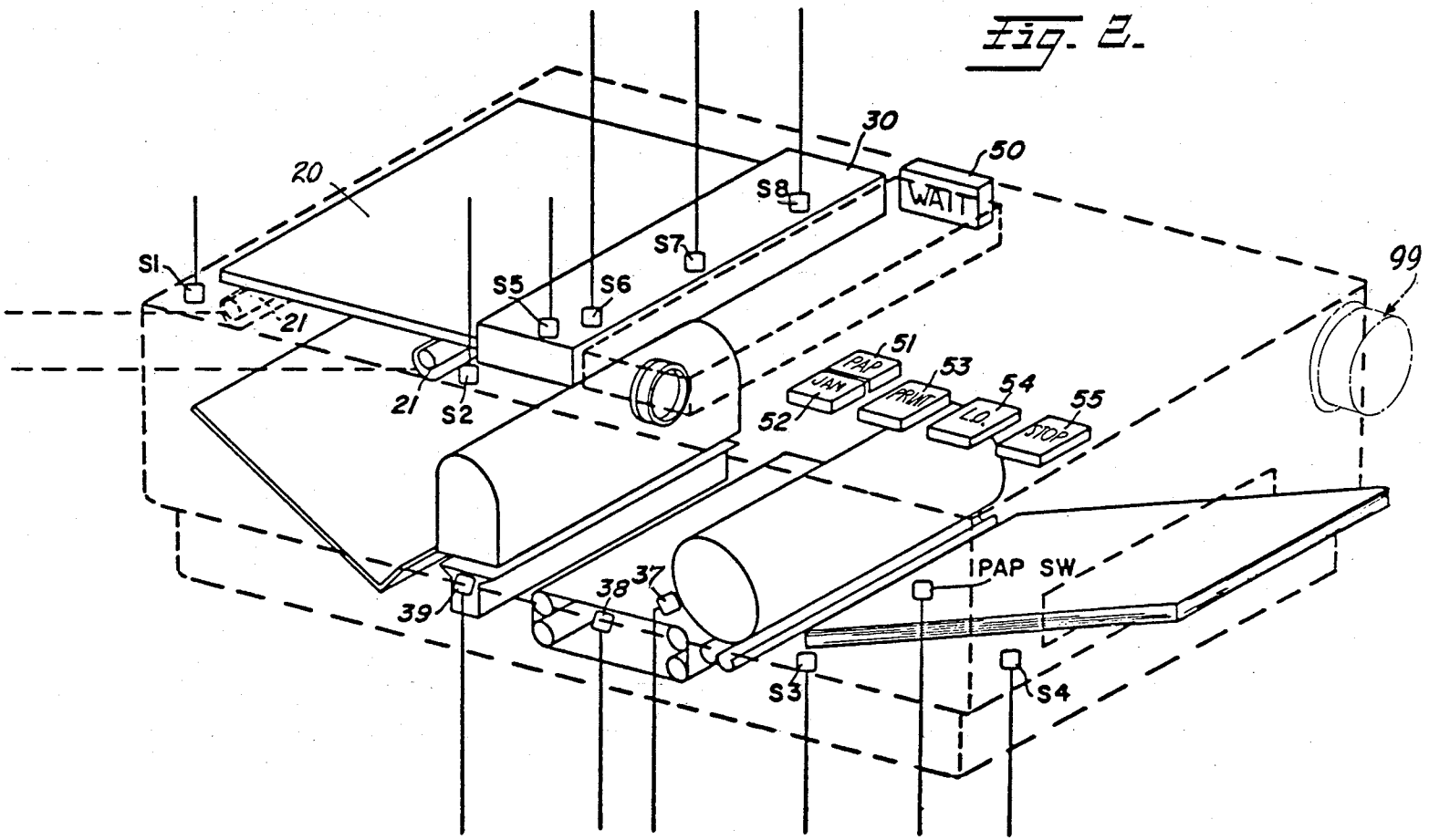
FIG. 2 is a perspective view of the copier/duplicator of FIG. 1 illustrating the positioning of control switches and sensing elements.

Referring to FIGS. 1 and 2, in BASE Mode operation, the scanning arrangement 21 is moved across the width of the platen 20 by a carriage (not shown) so that the associated optical means 22–25 projects the image of the original on the xerographic drum surface 12 at the image exposing station B. In BASE Mode operation, the machine is designed so that, in each copy run after an initial warm-up period, each successive xerographic copying cycle is accomplished in the same given time interval. The cycle time starts as the scanning means leaves the start scan position near the Home Switch S1 and continues to move past the platen and ends as it reaches the end of scan position at the End of Scan Sensing Switch S2. The next cycle begins as the scanning means automatically flies back to the home or start scan position. In BASE Mode, the operator may initiate a multiple copy mode by setting dial 99 to the desired number of copies.

In the LDC Mode of operation, a large document original is fed through a feeding means 30 such as that shown in a pending U.S. application Ser. No. 205,911 filed on Dec. 8, 1971, or in the U.S. Pat. No. 3,731,915 issued to Guenther. For example, as shown in the aforementioned copending application Ser. No. 284,687, the document feeding means 30 may be stationed outside of the platen 20 and be in a disengaged position when the machine is to operate in the BASE Mode as shown in dotted lines of FIG. 1. It includes a lever 31 which is designed so that by moving it clockwise the feeding means 30 is brought into or engaged into a position as shown in solid lines so that it can operate in the LDC Mode. In this position, the document original can be fed past the scanning station SS. A suitable mechanism 33 is provided in the machine for coupling feed rollers 34 to the main drive M when the document feeding means 30 is moved to the LDC position. Once engaged, the rollers 34 driven by the main drive M feeds the document original to the left past the scanning station SS. The speed with which the paper is fed past the scanning SS is synchronized with the speed with which the copy paper 36 from the paper cassette 15 is fed into a transfer relationship with the photosensitive insulating layer 12 by a suitable paper feeding means PF. When it is desired to operate the machine in the BASE Mode, the document feeding means is simply moved out of the way of the platen by rotating the lever 31 counter-clockwise rotation. The counter-clockwise rotation of the lever 31 moves the document feeding means 30 to the right as shown in dotted lines and out of the path of the scanning station SS. At the same time, the driving mechanism 33 disengages the feed rollers 34 from the main drive M to render the document feeding means inoperative. While in the illustrative embodiment, it is shown that the document original feeding means is moved from one position to another to engage or disengage the machine in the LDC Mode, it need not be so limited. For example, the document feeding means could be held at a fixed stationary position using suitable actuating means such as a push button to engage or disengage document feed rollers and thus selectively engage the feeding means for the LDC Mode.

In the BASE Mode, a control circuitry of a conventional design may be used to provide signals necessary for the selective enabling of certain elements such as charging, exposing, developing, image transferring, fusing and cleaning means that implement the steps necessary in making a copy. The circuitry may be of electro-mechanical or electronic components such as that shown in the U.S. Pat. No. 3,301,126 issued to R. F. Osborne et al on January 31, 1967, or that shown in the pending application Ser. No. 348,828 filed on Apr. 6, 1973, now U.S. Pat. No. 3,813,157 which acts to implement various xerographic process steps at appropriately timed intervals at various points in the processing operation under conditions where necessary timing is desired from a clock or cam mechanism or other suitable means. Generally, as described in the above mentioned copending application Ser. No. 367,996 for BASE Mode, the timing of the xerographic copying cycle is keyed to the scanning operation of the scanning means. Thus, in the BASE Mode, each cycle of xerographic processing steps during the making of successive copies in a copy run is keyed to the start and end of the scanning operation involving the movement of the scanner carriage between the home position (at Switch S1 in FIG. 1 or 2) and the end of scan position (at Switch S2 in FIG. 1 or 2).

In addition, the control circuitry is also provided with a suitable design such as that shown in the U.S. Pat. No. 3,588,472 issued to Thomas H. Glaster et al on June 28, 1971 or in the U.S. Pat. application Ser. No. 344,322 filed on Mar. 23, 1973, now U.S. Pat. No. 3,832,065 for detecting various malfunctions of the machine. For example, referring to FIGS. 1 and 2, the machine may include a detack detecting means 37 for detecting the failure of copy paper separation from the drum surface 12, a jam detection means 38 for detecting a paper jam that may occur along the paper path, and heat sensing element 39 for monitoring the temperature of the fusing station F. The output of these detecting means form a part of the input signals to the control circuitry of the present system.

In the present machine, various sensing elements in the form of switches are used to provide certain necessary input signals to the control circuitry. These switches are shown schematically in FIGS. 1 and 2; Table 1 contains a brief functional description of each.

TABLE 1

FUNCTIONAL DESCRIPTION OF INPUT SWITCHES (See FIGS. 1 and 2 for switch locations; FIGS. 3A–3B, 6 and 9 for switch interconnections)

| | |
|---|---|
| HOME SWITCH: | The Home Switch S1 is used for indicating that the optics scanning carriage is at the home or start position of the scan cycle. It is actuated when the optics scanning carriage is at the home position and provides two complementary outputs to the control logic circuitry. The outputs denote (in positive true logic terms) the "At |

TABLE 1-continued

| FUNCTIONAL DESCRIPTION OF INPUT SWITCHES (See FIGS. 1 and 2 for switch locations; FIGS. 3A–3B, 6 and 9 for switch interconnections) | |
|---|---|
| | Home" and "Off Home" condition of the optics Mode Change carriage. |
| END OF SCAN SWITCH: | The End of Scan Switch S2 is used to sense the presence of the optics scanning assembly at the end of scan position. It is normally deactuated and is actuated when the scanning assembly reaches the desired position. Upon actuation it provides a logical "0" level to the control logic. |
| TRAILING EDGE SWITCH: | The Trailing Edge Switch S3 is utilized to detect the trailing edge of a sheet of copy paper as it leaves feed rollers adjacent the paper cassette. It is normally deactuated and exhibits an open circuit. In the presence of copy paper it is actuated providing a logical "0"; on passage of the trailing edge it again opens removing the logical "0" from the control logic. |
| LARGE CASSETTE SWITCH: | The large Cassette Switch S4 is utilized to sense the presence of the large paper cassette in the paper tray. It is normally deactuated; it actuates in the presence of the large paper cassette thereupon providing a logical "1" to the control logic. |
| MODE CHANGE SWITCH: | The Mode change Switch S5 senses the movement of the document feeding means 30 into the LDC Mode position. It is normally in the open state. It closes momentarily as the document feeding means 30 moves into position for the LDC Mode of operation and starts the process of initializing the control logic circuitry. S5 is a one-way roll-over type switch that actuates in one way when the machine goes from the BASE Mode to the LDC Mode but not vice versa. |
| LDC MODE SWITCH: | The LDC Mode Switch S6 is actuated as the document feeding means 30 moves to the LDC Mode position from BASE Mode position. It is normally open. On actuation, it provides a logical "0" to the control logic circuitry. The logical "0" from this switch indicates a mode change of the machine from the BASE Mode to the LDC Mode; and further, of the continued operation of the machine in the LDC Mode. |
| DOCUMENT SWITCHES: | The Document Switches S7 and S8 are utilized to sense the document original being fed into the copier. The switches are normally closed, are connected in series, and provide a logical "0" to the control logic. One or both switches open in the presence of the document original to signify its presence. When thus opened, the logical "0" is removed from the control logic. Operation of either one or both is utilized to signify the presence of the document original as well as the leading and trailing edges of the document original. |

Briefly stated, the switches S1-S8 above are connected to operate and provide the following functions. The Home Switch S1 when actuated shows that the scan carriage is at the home position. The End of Scan Switch S2 is in a non-actuated condition at this point. Now suppose the operator wishes to operate the machine in an LDC Mode. The level arm 31 is moved clockwise to place the document feeding means 30 to the left and thereby place the machine in the large document copying mode. As the lever arm 31 is rotated, the LDC Mode Switch S6 is actuated and then the switch S5 is momentarily actuated. This initializes the control circuitry for the LDC Mode of operation.

In response to such initializing, the control circuitry causes the scanning arrangement and associated optics to move into the LDC position, that is, to the end of the scan position associated with switch S2. Furthermore, the control logic associated with LDC mode of operation is so designed that the action of copy paper feed solenoid II in selectively feeding copy paper is prevented or inhibited while the scanning elements 21 and 22 move to the end of the scan position. When the scanning elements reach the end of the scan position, this is sensed by the End of Scan Switch S2. In turn, the Switch S2 provides the End of Scan Signal. In response, the scanning and optic elements are retained in that position by a suitable pawl and ratchet mechanism. For a detailed discussion of an exemplary mechanism of this type, one may refer to the above mentioned copending application Ser. No. 367,996. This prevents the scan carriage means from automatically returning to the home switch position as is done in BASE Mode operations, and when the scanning means reaches the end of scan position, the main drive M drives the document original feed rollers 34.

In response to the end of scan signal, the control circuitry removes the constraints on the operation of the solenoid II to allow the copy paper feeding means PF to selectively operate. With the solenoid enabled, the drive belt means 41 and 42 are prevented from engaging with the main drive M and no copy paper is fed. When solenoid II is de-actuated by the control logic in response to an actuation of the Document Switches S7 and S8, as the document original passes thereby, the drive belt means engage the main drive M is allowed to drive the copy paper feed rollers 44 in synchronism with the speed with which the document original is fed past the scanning station SS. The switches S7 and S8 actuate as the document original paper is fed therepast in the paper feeding means 30, and enables the control logic to proceed with LDC Mode of copying operation. Absent any malfunction, the machine proceeds to complete the copying operation.

There are a number of indicating means that may be provided in the copier/duplicator machine, as shown in FIG. 2, to provide the following functions:

| | |
|---|---|
| WAIT | This is a visual indication means 50. It is connected in a manner to provide the "Wait" indicia when document feeding means 30 is moved to the LDC position, and this condition is maintained by the control circuitry until the scanning element 21 moves to the end of the scan position and the machine is ready to make copies. The lighted indicating means 50 comes to the view of the operator during this time and alerts the operator to wait until the indication terminates before the document original sheet is fed through the feeding means 30. The indicating means 50 may include a suitable notation "WAIT" for the operator's convenience. Preferably, the light indicating means 50 may be positioned above the console of the base machine as shown in FIG. 2 at a position where it will be hidden behind the housing of the paper feeding means 30 when the same is positioned for BASE Mode operation. The wait light comes on from the time of charging until exposure is turned off. |
| ADD PAPER | An indicating means 51 "ADD PAPER" is provided to apprise an operator that attention to the paper supply is necessary. It may be so connected that it is energized by the control circuitry when the paper supply runs out or when the incorrect size paper supply is present. |
| CLEAR PAPER PATH | This indicating means 52 is provided to signify to the operator the paper jam condition is present and requires clearing. |

In addition, certain controls are provided in the machine for inputting particular command signals to the control circuitry. For example:

| | |
|---|---|
| PRINT | This input, button 53, is used to enable the operator to start the machine in the BASE Mode or in the alternative in the LDC Mode if the machine is already held in the LDC Mode. |
| LIGHT ORIGINAL | This input, button 54, serves the function of starting the appropriate machine cycle when the original is light and it is desired to provide a darker copy. If the machine is in the BASE Mode, it may be placed in the LDC Mode by moving the lever arm clockwise and movement of the lever is accomplished by the operation of the momentary switch S5 and the LDC Mode Switch S6 to provide the print command signal. However, if the machine is already in the LDC Mode, then a depressing of either the PRINT button 53 or LIGHT ORIGINAL button 54 provides the print command signal. |
| COPY QUANTITY DIAL | This input, dial 99, is used to enable the operator to select the number of copies desired of a single original document It is operative only in the BASE Mode of operation. |
| STOP | The STOP input, button 55, is used for stopping the machine in the middle of its operation and causes the control circuitry to stop the machine at the end of the copying cycle in process. |

The features tabulated above are common to many copier/duplicators well known in the art and their use in multi-mode copier/duplicators is more fully set forth in the above mentioned copending application of L. R. Sohm entitled "Dual Mode Control Logic For A Multi-Mode Copier/Duplicator" (D/73383C).

2. Adaptive Fuser Control Circuit

The adaptive fuser control circuit of the instant invention is set forth in three separate levels of description, namely, a Block Diagram Description, a Timing Diagram Description and a Detailed Logic Description.

a. Block Diagram Description

FIG. 2 is a block diagram of the electronic circuits of the copier/duplicator and comprises a BASE LOGIC CIRCUIT 300, LDC LOGIC CIRCUIT 302, ADAPTIVE FUSER TURN-ON LOGIC CIRCUIT 304, ADAPTIVE FUSER TURN-OFF LOGIC CIRCUIT 306, FUSER SUPPLY REGULATOR 308, FUSER ELEMENT 310, and SOFT TURN-ON LOGIC 312. The BASE LOGIC 300 and LDC LOGIC 302 circuit are responsible for controlling the basic xerographic process during a BASE and LDC Mode of operation in response to input switches as described in Table 1. Of these switches, switches S3, S4, S6, S7, S8, S9 and Print are indicated in detail and each is shown connected so as to provide a ground or open circuit to the LDC LOGIC 302 when actuated. The BASE LOGIC CIRCUIT 300 and LDC LOGIC CIRCUIT 302 are more fully described in a copending application Ser. No. 393,546 filed Aug. 31, 1973, (now abandoned), continuation application Ser. No. 528,163 filed Nov. 29, 1974, (D/73383C); and Ser. No. 367,996 filed June 7, 1973. Interconnections of the instant Adaptive Fuser Controller to the BASE Logic 300 and LDC LOGIC 302 are shown in detail and fully explained below.

The TURN-ON LOGIC CIRCUIT 304 comprises Decode Logic Circuits 304A–304C for decoding signals from binary counters corresponding to a Program Counter state of 72, Master Counter state of 72 and Master Counter state of 152, respectively. Accordingly, the CT72P Decode Logic 304A is connected to a Program Counter 316 via Program Counter State lines 322 and LDC LOGIC 302; CT72M Decode Logic 304B is connected to a Master Counter 318 via Master Counter State lines 324 and LDC LOGIC 302; and CT152M Decode Logic 304C is connected to the Master Counter 318 via Master Counter State lines 316 and LDC LOGIC 302.

The Decode Logic Circuits 304A–304C provide fuser turn on signals via lines **328*a* and 328*b* to a Fuser Mux (Multiplexer) 127M. CT72M Decode Logic 304B and CT152M Decode Logic 304C outputs are both routed via line 328*b* to the "Base" input to the Fuser Mux 127M whereas the CT72P Decode Logic 304A output is fed to the LDC input of the Fuser Mux 127M. Fuser Mux 127M selects one of its two inputs in response to a signal from LDC LOGIC 302 designated as LDC Mode Enable applied via a line 330, and presents the selected signal to the ON node of a FUSER LATCH 332 via a line 334. The output of FUSER LATCH 332 activates the FUSER ELEMENT 310 via a line 336, the FUSER SUPPLY REGULATOR 308, line 338, a Fuser Triac 340 and line 342. Thus it is seen that three different turn on signals (from Decode Logic Circuits 304A–304C) may actuate FUSER ELEMENT 310.** These turn on signals correspond to a plurality of modes of operation of the copier/duplicator as described more fully below.

Additional outputs from LDC LOGIC 302 allow for the dynamic turning off of the FUSER ELEMENT 310 by supplying the TURN OFF LOGIC 306 with continuous status of the copier/duplicator cycle. A Trailing Edge Switch signal via a line 342 is routed to an Auxiliary Logic Circuit 346 which selectively permits the output of Clock Pulses (which may be 60Hz) to be applied via a line 348 to a Fuser Counter 306A. At appropriate times a Reset signal provided via Auxiliary Logic 346 is applied to Fuser Counter 306A via a line 350. The output of Fuser Counter 306A is first applied in the form of a group of counter states to a CT184F Decode Logic 306B via lines 352 and further to a CT208F Decode Logic 306C via lines 354. A further input to Decode Logic 306B is a Large Cassette Switch signal supplied on line 356 via the LDC LOGIC 302. The outputs of Decode Logics 306B and 306C are fed to an OFF node of FUSER LATCH 332 via a line 358. Thus it is seen that control of the turn off times of the FUSER ELEMENT 310 is conditioned by dynamic timing associated with the copier/duplicator and that a multi-mode and adaptive turn off capability is achieved.

In addition to the fuser turn-on at full power a SOFT Start feature is also provided. SOFT Start refers to energizing the FUSER ELEMENT 310 at lower power (insufficient to achieve proper toner fixing) in advance of the time actual copier/duplicator fusing is to occur in order to prevent current surges and thus to obtain improved copy quality. At appropriate times, the full fuser turn-on overrides the SOFT Start operation. To implement SOFT Start, the LDC LOGIC 302 provides an LDC Expose Signal via a line 360 and a BASE Expose signal via a line 362 to an Expose Mux 125M. One of these signals is selected in response to the LDC Mode Enable signal fed along line 330, and applied to a Photo Coupler 312A via a line 364. The output of Photo Coupler 312A is routed to a Soft Turn-On Relay K1 via line 336 and in turn to the FUSER ELEMENT 310 via line 368*a*.

Cycle Of Operation In Base Mode

In the BASE Mode of copier/duplicator operation, a copy sequence is initiated by depressing the Print Button 53 or 54. Operation of the Print Button 53 intitializes the control circuitry throughout the machine (via Initialization Circuit 320), clears and starts the Master Counter 318, and turns on the exposure lamp thereby energizing the FUSER ELEMENT 310 at low power (SOFT Start). The particular path for the SOFT Start Turn-On comprises line 362, Expose Mux 125M, line 364, Photocoupler 312A, line 366, Soft Turn-On Relay K1 and line 368*a*. The low power fuser operation is controlled directly by the logic circuitry EXPOSE MPX 125M which energizes the copier/duplicator exposure lamp (via the BASE LOGIC exposure latch) and therefore is activated whenever the exposure lamp is lit.

Subsequent to the initiation of a copy cycle, a number of xerographic processes are initiated under the control of the BASE LOGIC 300. The time at which the first fusing action occurs is conditioned by the number of copies ordered, as set on dial 99 by the operator. Thus the BASE Mode Operation is further divided into a Single Copy Run and a Multiple Copy Run.

In the Single Copy Run case, full fuser turn on is achieved approximately 0.5 seconds before the leading edge of the copy paper reaches the center of the fuser station. At this time, the Master Counter 318 has accumulated 72 counts (clock rate of 60 Hz). The Master Counter State Lines 324 feed the Master Counter States to the CT72M Decode Logic 304B for decoding. Decoding is logically conditioned upon the existence of an Expose signal via an output from the Expose Mux 125M along line 370 to the Decode Logic 304B and upon the existence of a Coincidence signal origination in the BASE LOGIC 300 and fed to Decode Logic 304B via a line 374 and 376. The Coincidence signal is used to indicate that the present machine copy cycle completes the number of desired copies preset by the operator. For Single Copy Runs, a Coincidence signal occurs during each machine cycle. After decoding, the output of CT72M Decode Logic 304B is routed via line 328*b* to Fuser Mux 127M and subsequently to the FUSER LATCH 332 via line 334. The output of FUSER LATCH 332 in turn causes the FUSER ELEMENT 310 to be energized via line 336, FUSER SUPPLY REGULATOR 308, line 338, Fuser Triac 340 and line 342. At this time both SOFT TURN-ON and full power signals are applied to FUSER ELEMENT 310 in parallel: however, the full power signal overrides the SOFT Start at the Master Count of 72.

In Multiple Copy Run, fuser SOFT Start is accomplished identically as described above for the Single Copy Run case. However, full fuser turn-on is accomplished approximately 1 second earlier in the machine cycle than for the Single Copy Run case. The desired turn-on time corresponds to the accumulation of 152 counts in the Master Counter 318. (As will be described more fully below in connection with the timing diagrams of FIGS. 4 and 5, the Master Counter is reset periodically in response to various xerographic processes. These processes are defined in particular SEQUENCES (SQ); thus, there is no absolute significance to counts 72 and 152 as they occur in different sequences.) For full power fuser turn-on, the CT152M Decode Logic 304C is utilized. The Master Counter counts are fed to the Decode Logic 304C via lines 326 and LDC LOGIC 302. Decoding is here logically conditioned upon a Coincidence signal from Base Logic 300 via lines 374 and 378, and upon a Development Signal from BASE LOGIC 300 via line 380. The output of the CT152M Decode Logic 304C is fed to the Fuser Mux 127M and subsequently an actuation signal is fed to the FUSER ELEMENT 310 as in the case of the Single Copy Run.

The Fuser Counter 306A used for fuser turn-off is conditioned inter alia, by the actuation of the Trailing Edge Switch S3, which corresponds to the arrival of the trailing edge of the copy paper in use at a certain predetermined location in the machine. Upon the deactuation of Switch S3, a Count Enable signal is generated in the Auxiliary Logic Circuit 346 and the Fuser Counter 306A is actuated, subsequently reset, and thereupon begins to accumulate 60 Hz Clock Pulses via line 348. Fuser Counter States via line 352 are applied to CT 184F Decode Logic 306B, which also receives a Large Cassette Switch S4 signal via line 356. In BASE Mode the use of a large paper cassette is precluded, so the circuitry functions to select CT 184F Decode Logic 306B as providing the operative turn-off output on line 358 to the OFF mode of FUSER LATCH 332. The significance of count 184 (at a clock rate of 60 Hz) lies in its allowing the appropriate time lapse for the trailing edge of the copy paper to travel past the centerline of the fuser element in the fusing station before turn-off. The fuser turn-off associated with CT 208F Decode Logic 306C is discussed below in connection with LDC Mode Operation.

Cycle Of Operation In LDC Mode

In the LDC Mode of copier/duplicator operation, a copy sequence is initiated by the actuation of one or both of the Document Switches S7 and S8 (see Table 1). Activation of the Document Switches S7 or S8 initializes the control circuitry throughout the machine via Initialization Circuit 320, and clears and starts the Master Counter 318. The SOFT Start feature is also used in LDC Mode operation, and its initiation is conditioned by an LDC Expose Latch located in LDC LOGIC 302. As shown in LDC timing diagram FIG. 5, SOFT Start is initiated by the Master Counter 318 at the count of 16, which is slightly later than its initiation time in BASE Mode operation; however all other aspects of SOFT Start are identical to those as summarized in BASE Mode description above. The particular path for LDC SOFT Start comprises an LDC Exposure Latch located in LDC LOGIC 302, a line 360, Expose Mux 125M, line 364, SOFT Start TURN-ON LOGIC 312, line 368*a*, and FUSER ELEMENT 310.

Subsequent to the initiation of a copy cycle, a number of xerographic processes are performed under the control of BASE LOGIC 300 and LDC LOGIC 302. Beyond the time of initial SOFT Start for a given machine operation, the times at which the various fuser operations occur are primarily conditioned by the size of the copy paper cassette utilized. Cassette size thus defines two distinct submodes of operation - Large Cassette and Small Cassette, which are described separately below.

Figure 4:
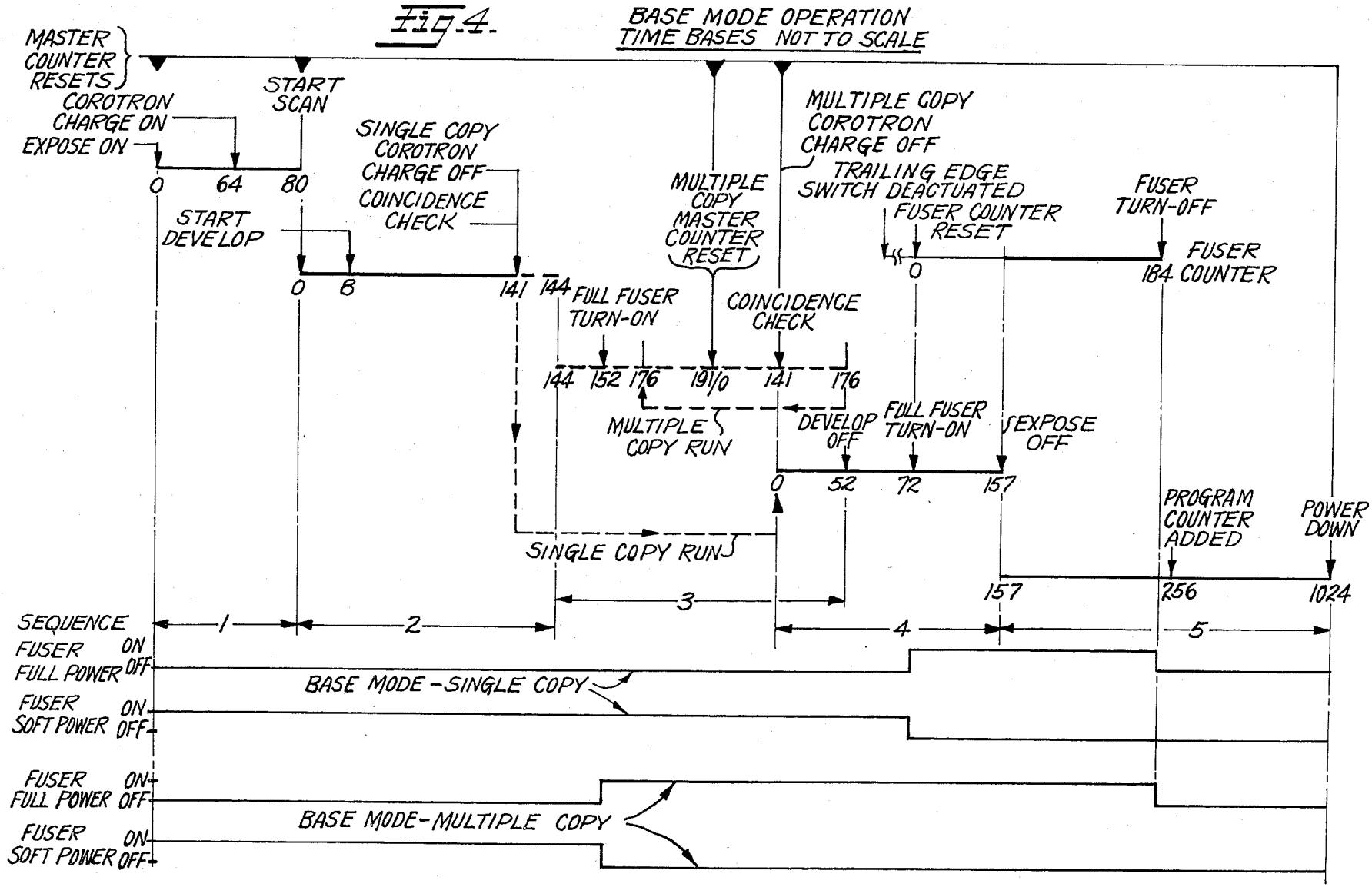
FIG. 4 is a timing diagram showing the sequence of operation of the copier/duplicator in the BASE mode.

In the Large Cassette Submode the fuser full turn-on occurs nominally 0.5 seconds before the arrival of the copy paper at the centerline of the fuser station. At this time the Master Counter has accumulated 72 counts. (Timing diagrams of FIGS. 4 and 5 illustrate the relative phasing of counter states for the various modes and sequences.) Specifically, Master Counter states via lines 324 are applied to CT 72M Decode Logic 304B where the desired state is decoded and logically conditioned by the Coincidence signal via line 376 and the Expose signal via line 370 from the Expose Mux 125M. The Large Cassette Submode is functionally a single copy operational cycle; therefore, a Coincidence signal is generated for each copy made. The output of CT 72M Decode Logic 304B is fed via line 328*a* to the Fuser Mux 127M where it is selected through to the ON mode of FUSER LATCH 332 via line 334. Full fuser turn-on overrides the SOFT Start and proceeds via line 336, FUSER SUPPLY REGULATOR 308, line 338, Fuser Triac 340 and line 342 to FUSER ELEMENT 310.

Fuser turn-off in the Large Cassette Submode is dynamically conditioned by the length of copy paper in use as sensed by the Trailing Edge Switch S3. The Fuser Counter 306A after having been cleared by a Reset signal via line 350 begins to accumulate 60 Hz clock pulses via line 348 in response to the deactuation of the Trailing Edge Switch S3. Fuser Counter 306A states via lines 352 and 354 are applied respectively to CT184F Decode Logic 306B and CT208F Decode Logic 306C. The Large Cassette Switch signal provided via LDC LOGIC 302 on a line 356 disables the CT184F Decode Logic 306B, and thus the CT208F Decode Logic 306C is the operative circuit which is connected to the OFF node of FUSER LATCH 332. FUSER LATCH 332 is thereby reset at count 208F to deenergize the FUSER ELEMENT 310. The significance of counter state 208 lies in its correspondence to the time required for the trailing edge of the large copy paper (14 × 18 inches) to proceed from the Trailing Edge Switch S3 to slightly past the centerline of the fuser station.

In the Small Cassette Submode, a special capability of the copier/duplicator of the illustrative embodiment called chain feeding is implemented. This feature permits copies of different original documents to be made in rapid succession such that a number of sheets of copy paper are being processed in the machine at the same time. A full description of chain feeding is contained in a concurrently filed application assigned to the same assignee entitled "Chain Feeding Logic For A Multi-Mode Copier/Duplicator", BY W. L. Valentine. In the chain feeding submode, the fuser operations are controlled by a second computer, Program Counter 316 which provides the timing for fuser turn-on. This second counter is used in order that the previously used Master Counter 318 may continue to provide control for the required xerographic functions and accept subsequent original copy inputs, while the Program Counter 316 provides a separate time base for processing and controlling the copy already in progress.

The Program Counter 316 is cleared, enabled and begins to accumulate 60 Hz clock pulses in response to three conditions: (a) LDC Mode is in use; (b) a Large Cassette is not in use (this defines the Small Cassette Submode); and (c) a Coincidence signal has occurred. These signals are developed in LDC LOGIC 302 and BASE LOGIC 300. The Program Counter states are routed via line 332 to a CT 72P Decode Logic 304A where the count of 72 is decoded and passed via a line 328*a* to the Fuser Mux 127M. The output of Fuser Mux 127M is routed to the ON node of FUSER LATCH 332 via line 334 and is used to energize the FUSER ELEMENT 310 via the identical path as previously employed. The count of 72 provides for full fuser turn-on 0.5 seconds before the copy paper reaches the centerline of the fusing station.

Fuser turn-off occurs at a count of 184 of the Fuser Counter 306A in a manner identical to that described under BASE Mode operation. The path comprises: Trailing Edge Switch S3, Fuser Counter 306A, line 352, CT184F Decode Logic 306B, and line 358 to the OFF node of FUSER LATCH 332. The SOFT Start feature is implemented in the Small Cassette Submode identically as outlined for the Large Cassette case.

b. Timing Diagram Description

General

As may be seen by reference to FIGS. 4 and 5, a number of distinct phases of copier/duplicator operations exist which correspond to the various modes and submodes of available copymaking cycles. The logic control circuits involved are clock controlled, lending themselves to unambiguous description in terms of their actuating counter states of the Master Counter, Program Counter and Fuser Counter.

Figure 5A:
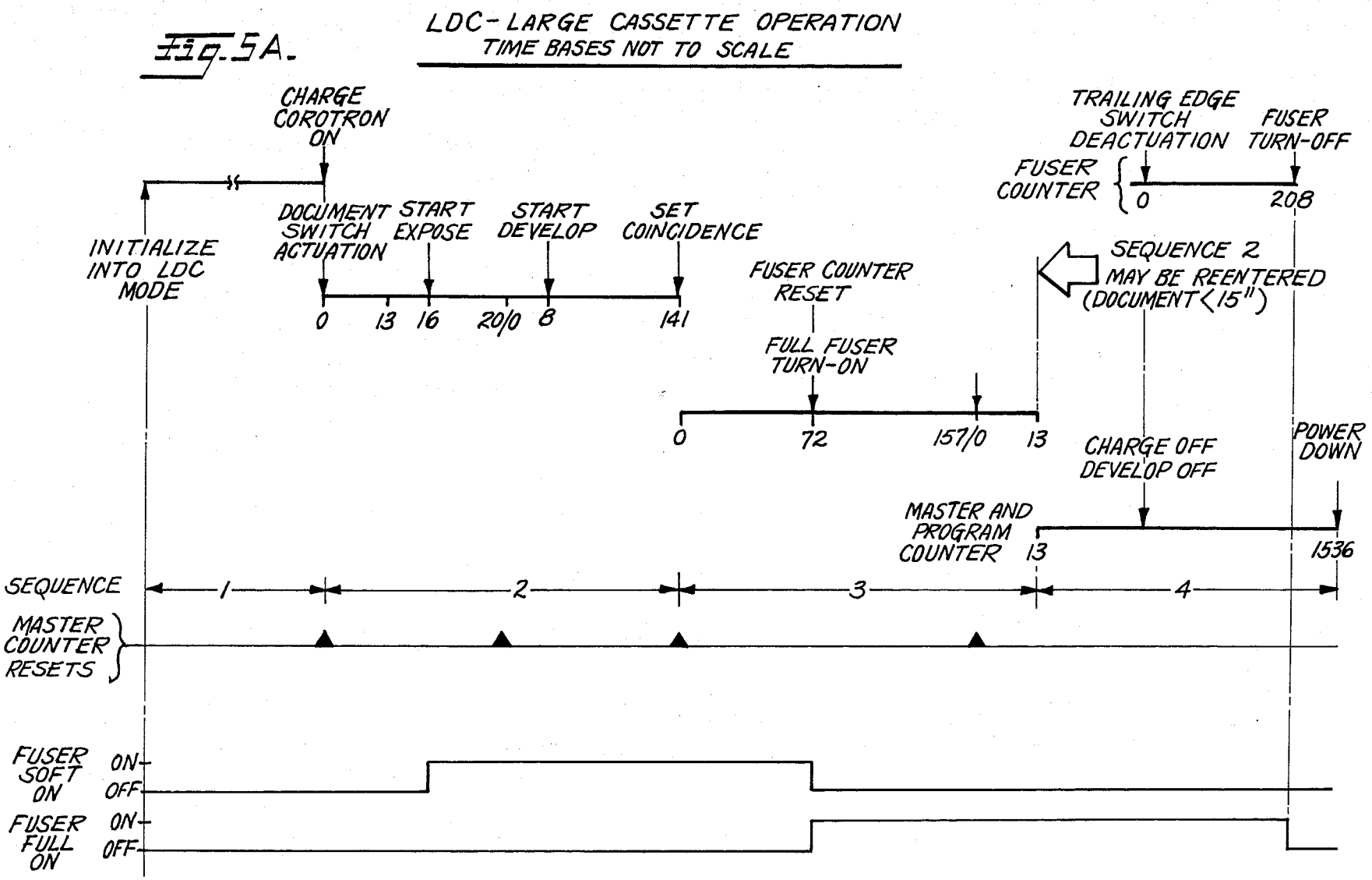
FIGS. 5A–5B are timing diagrams showing the sequence of operation of the copier/duplicator in the LDC Mode.
Figure 5B:
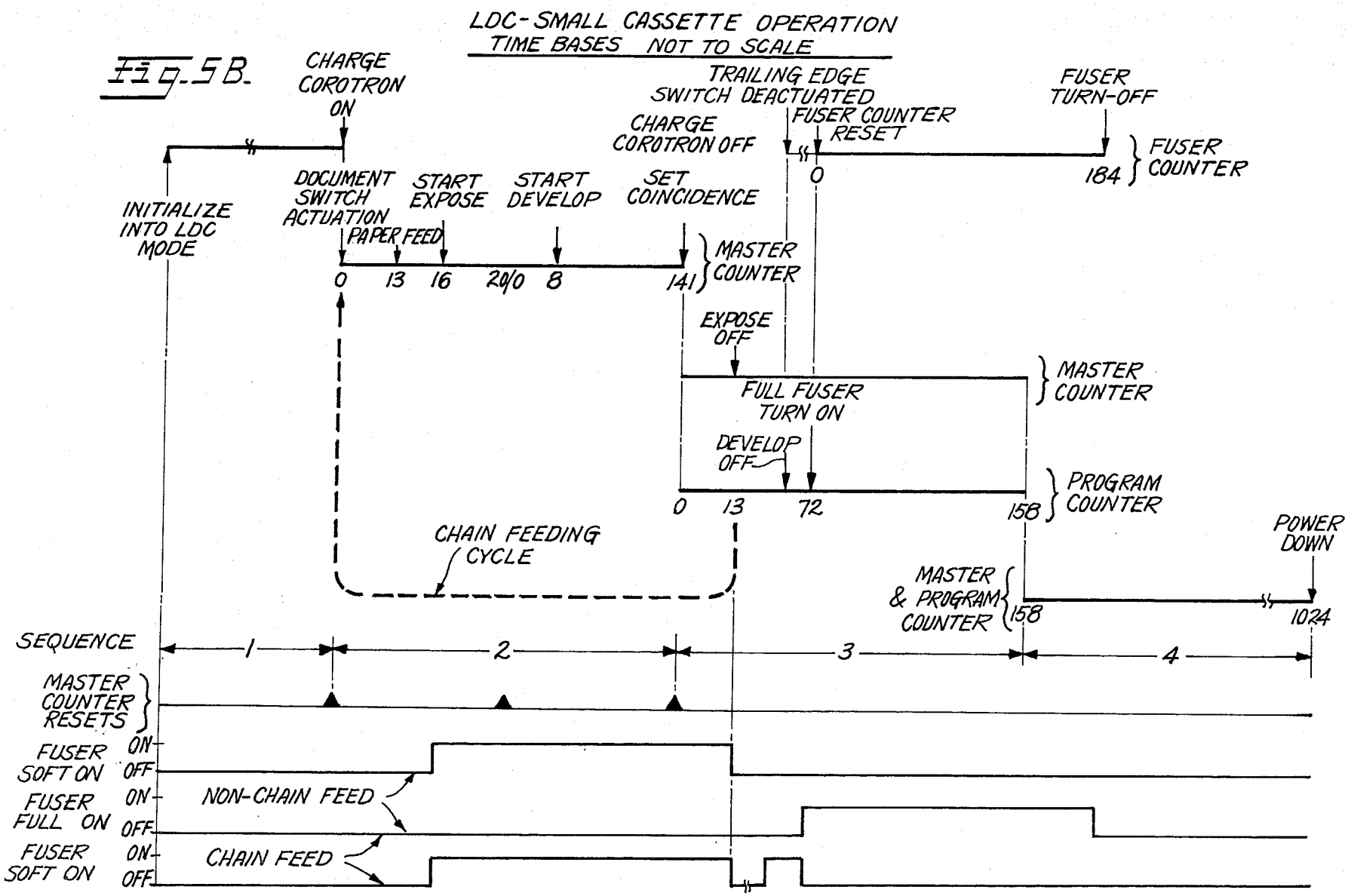
Figure 8:
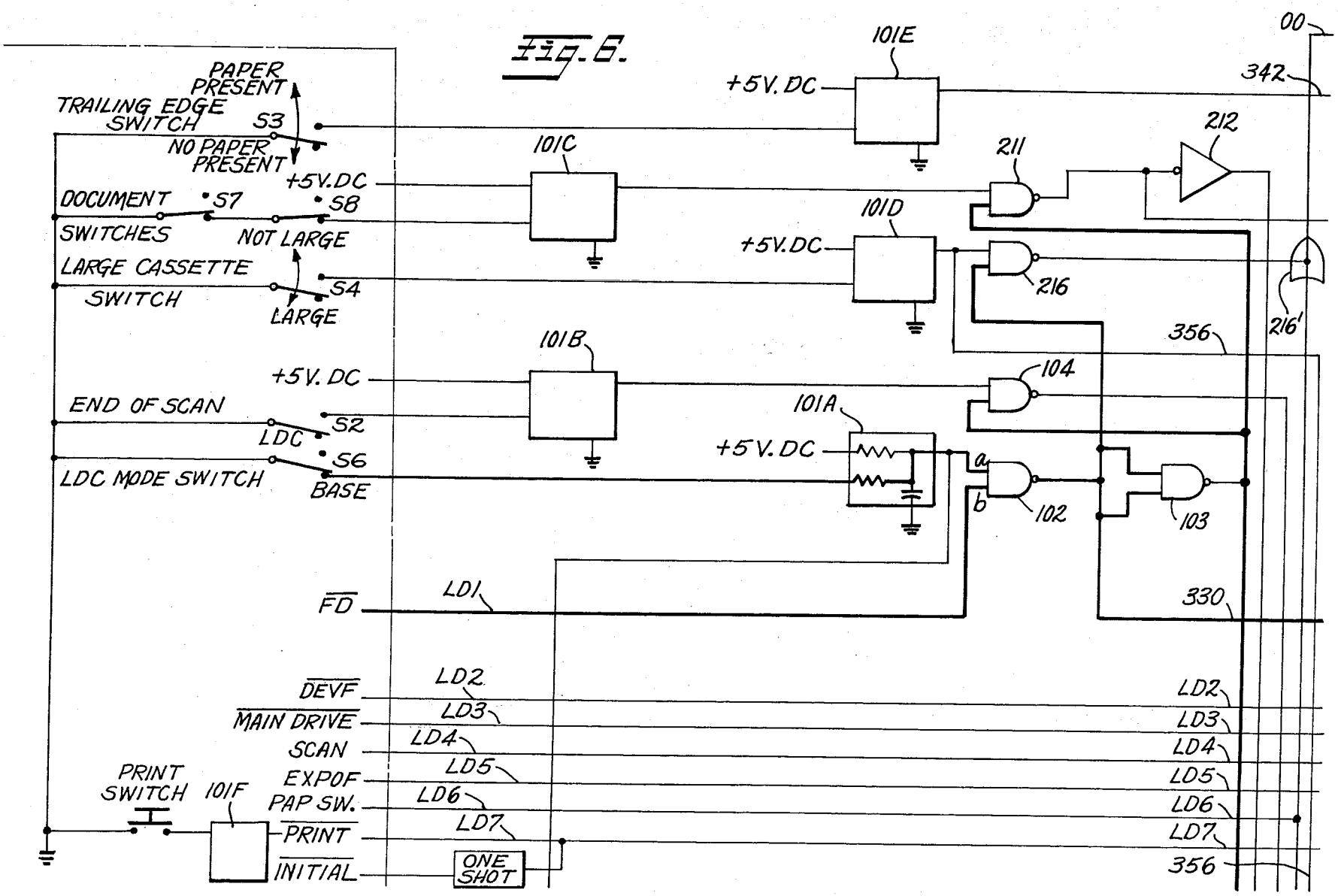
Figure 7:
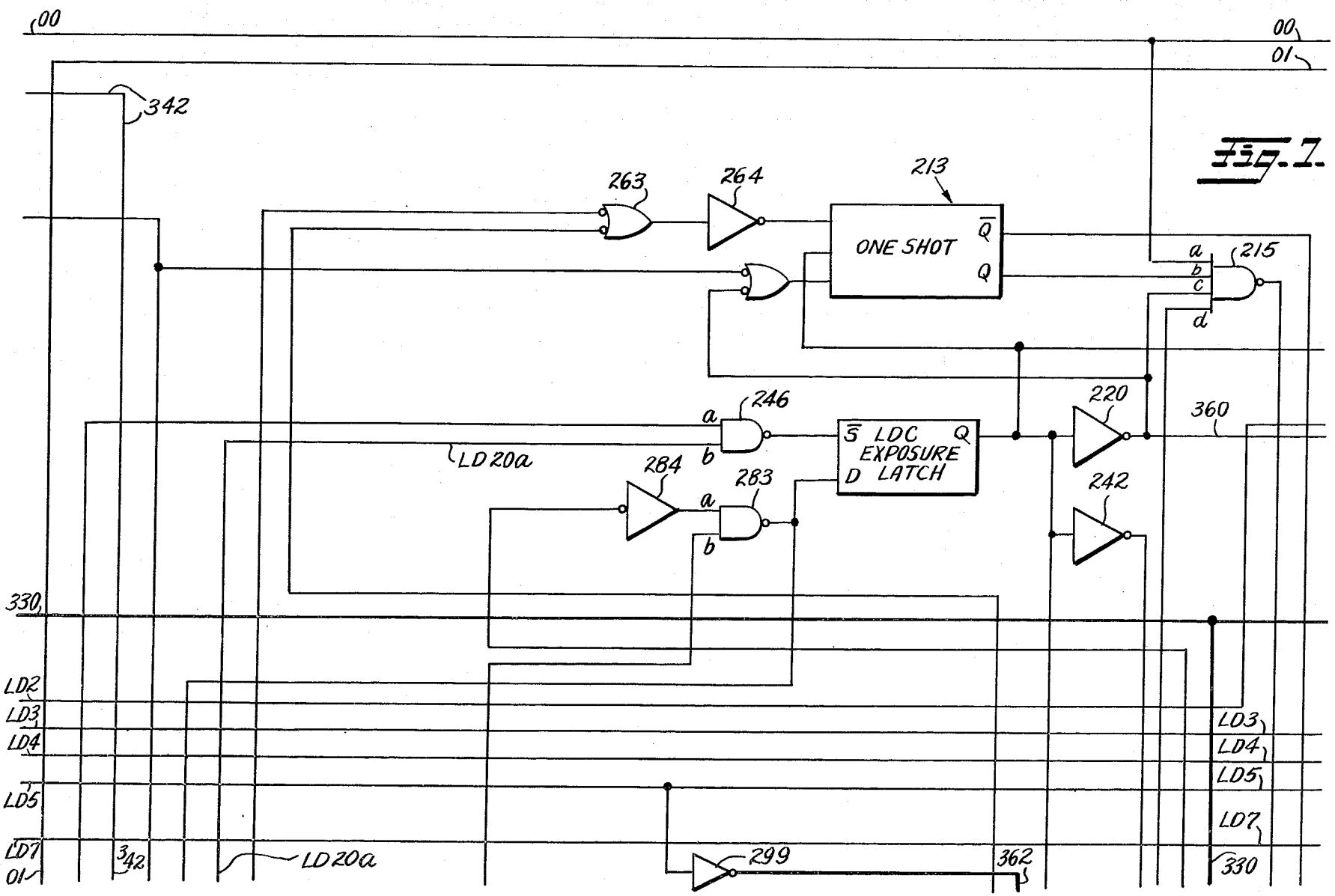
Figure 8:
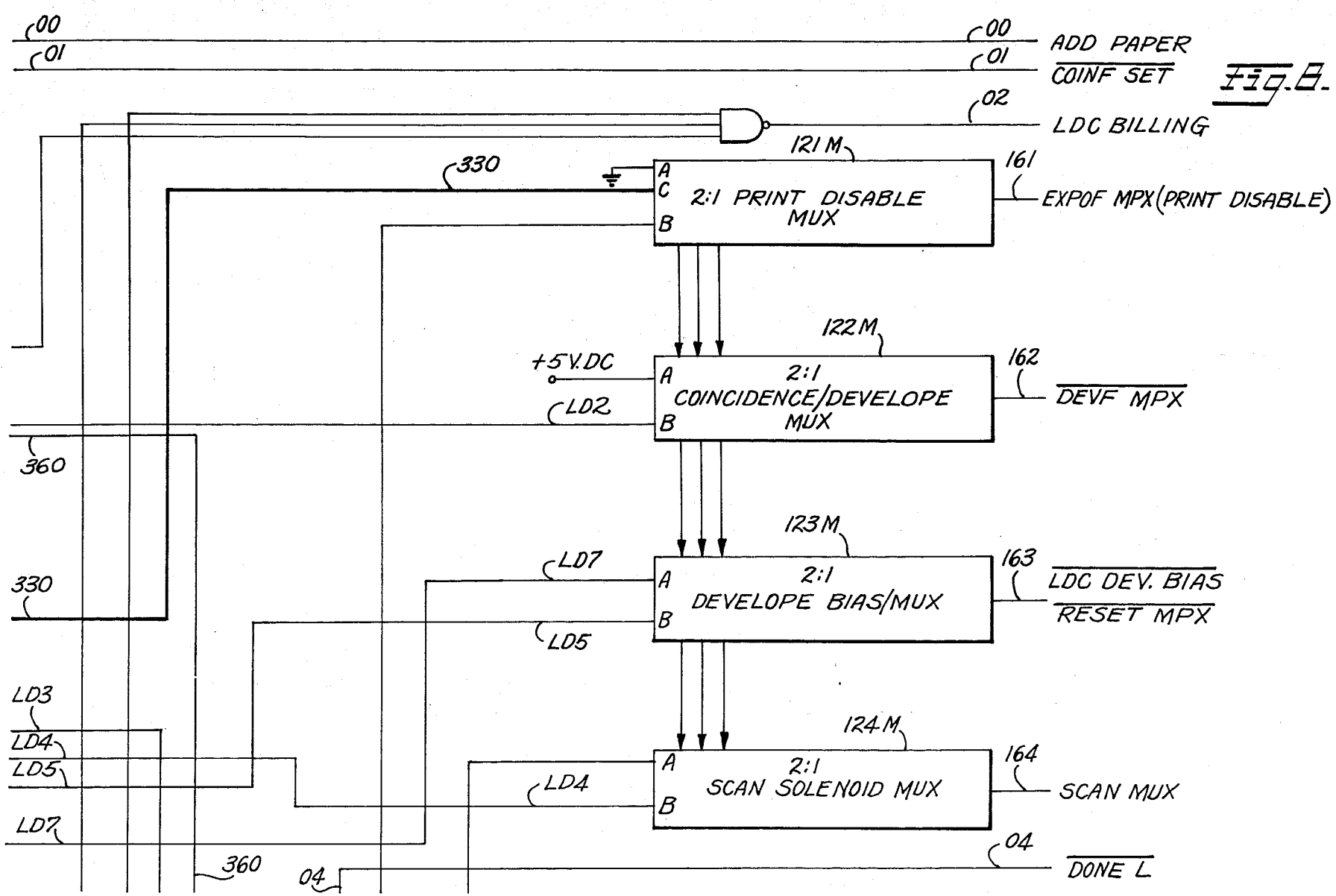
Figure 9:
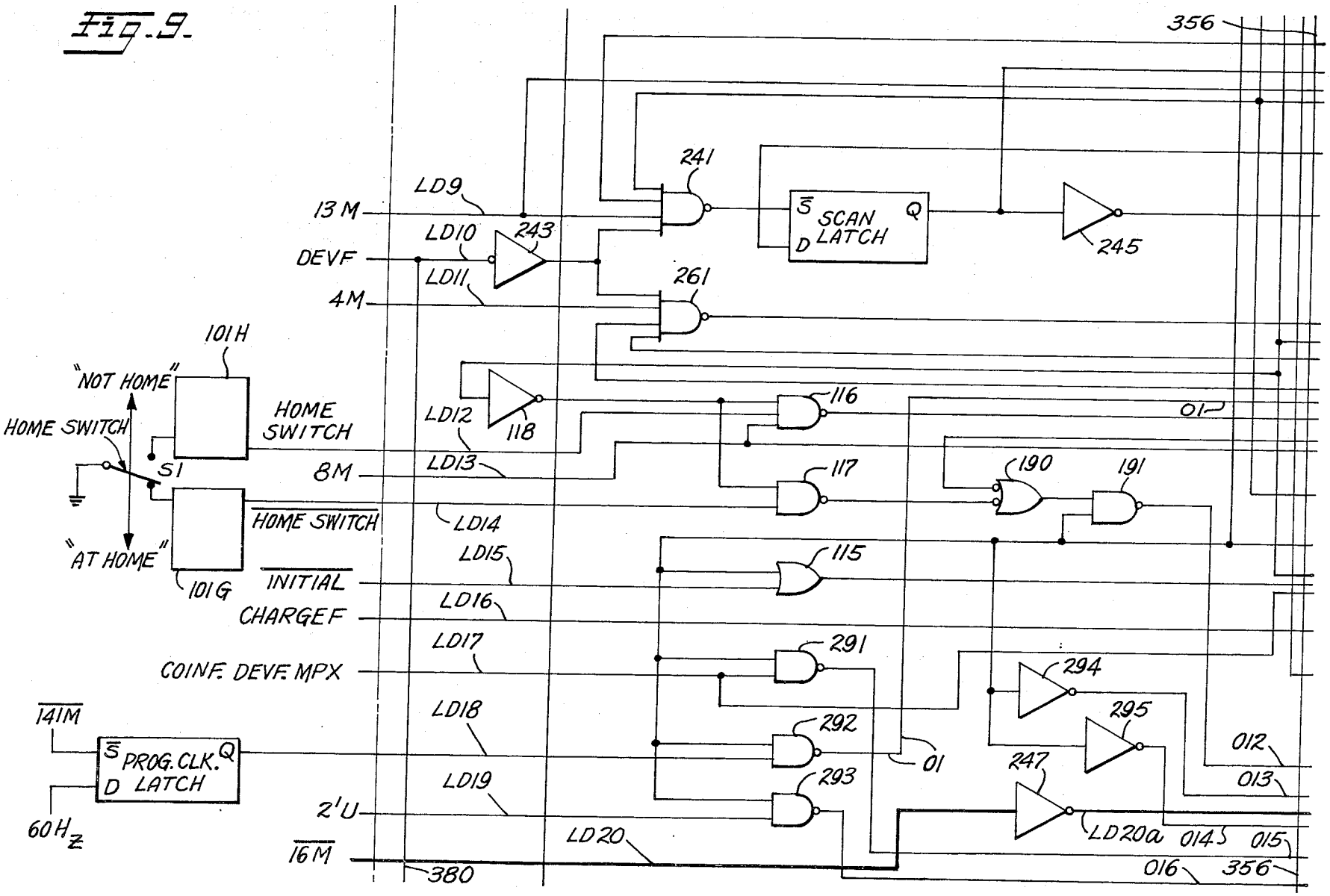
Figure 7D:
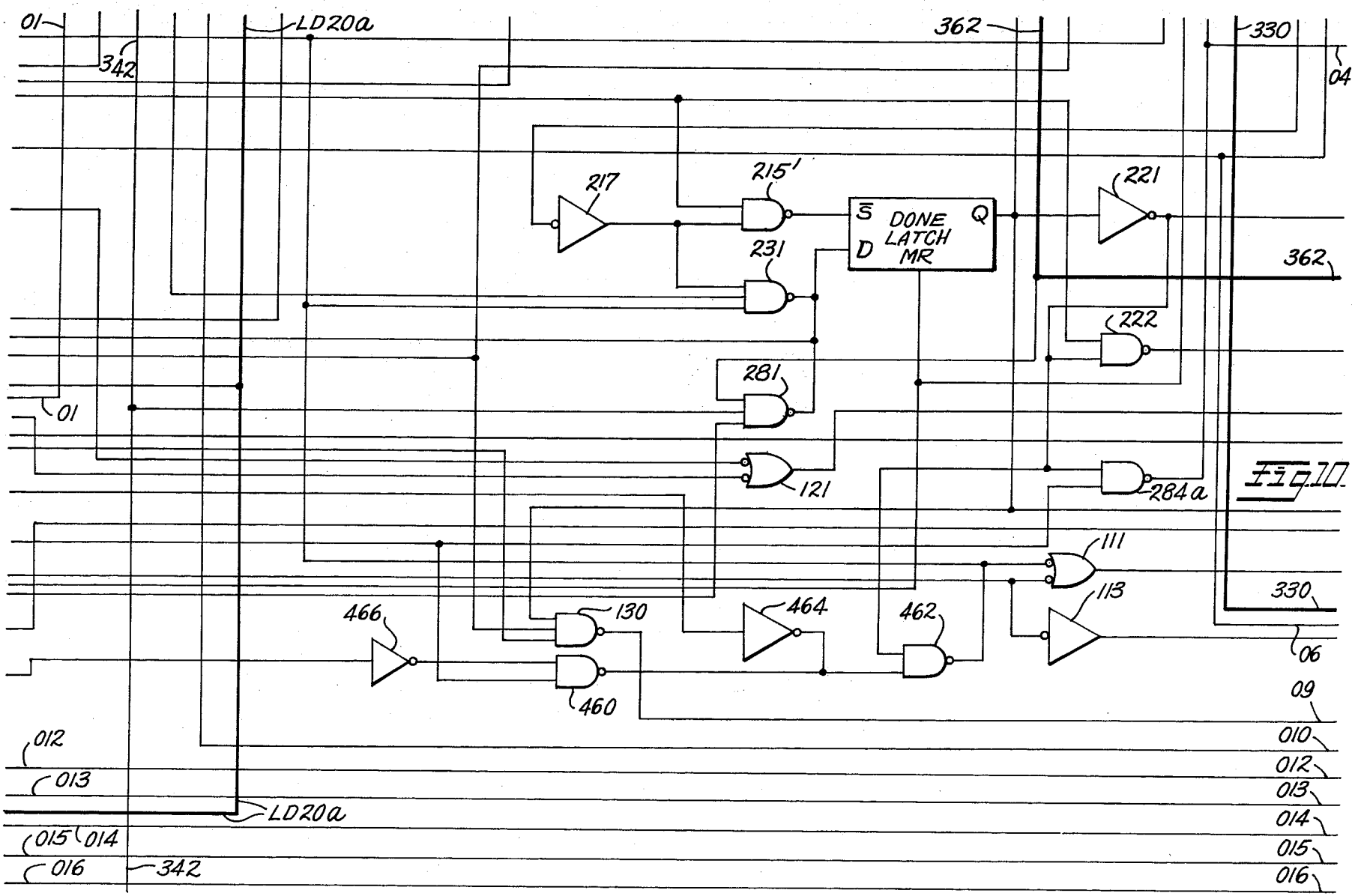
Figure 11:
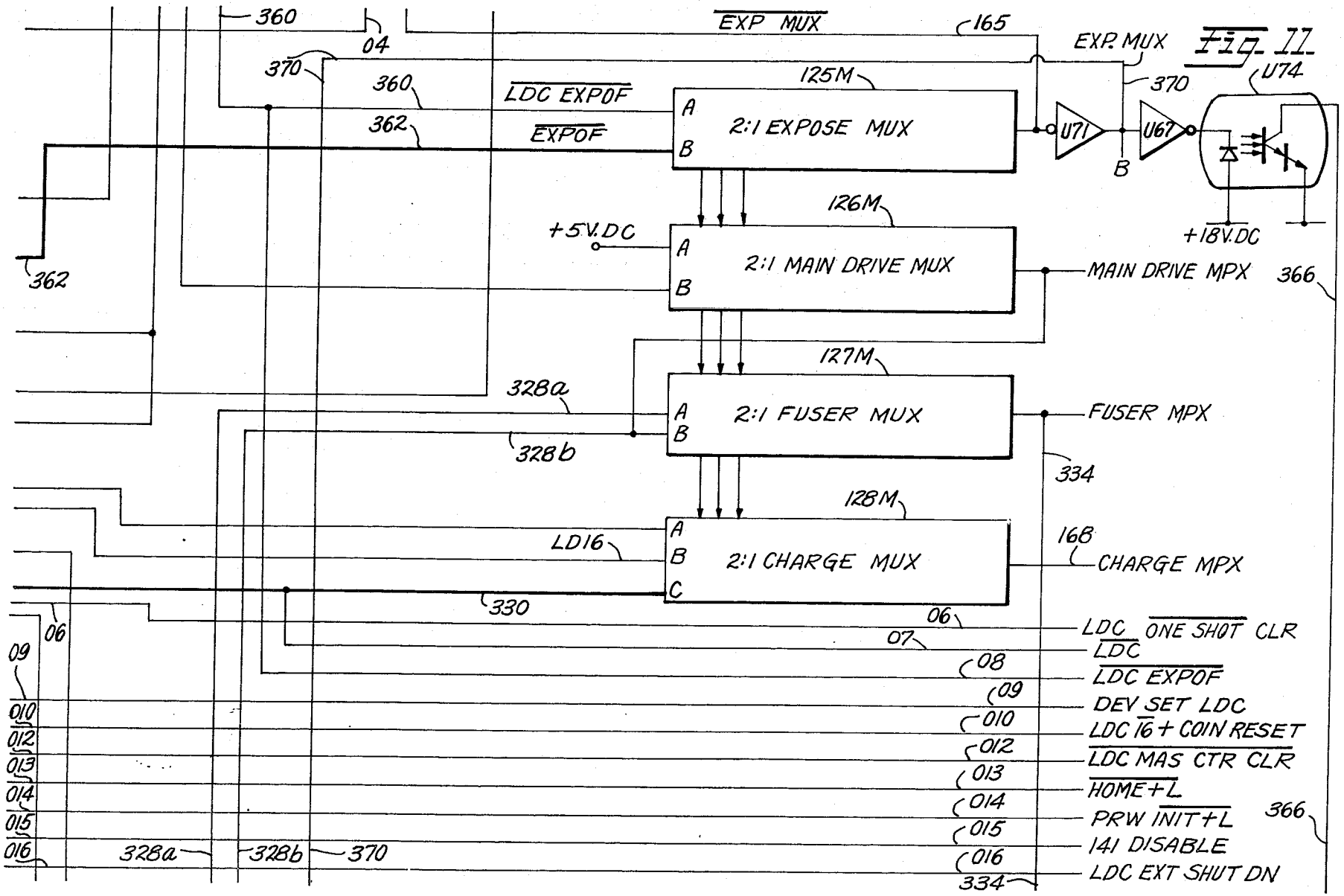

As an example to illustrate the counter state description used herein, consider the designation $\overline{CT72M}$-SQ2. This designation indicates that the Master Counter (M = Master Counter, P = Program Counter, F = Fuser Counter) has accumulated 72 clock pulses, and the designation refers to the counter signals which are decoded in the conventional manner by sampling the pertinent stages of the Master Counter. Also in the usual notation, a "bar" is used to denote the logical inverse of the counter state; i.e., this particular signal will exhibit a low logic level (logical 0) on the accumulation of the 72nd clock pulse, when suitably decoded. The designation SQ2 denotes the second sequence in a particular operating mode. Note for example that FIG. 4 shows the BASE Mode cycle of operation consisting of five distinct sequences. When a particular sequence is further conditioned by size of copy paper cassette, the appropriate designation is appended to so indicate by the addition of /SC or /LC denoting Small Cassette or Large Cassette Submodes respectively. FIG. 5B shows such a condition, wherein the FUSER LATCH is set to the high state in sequence three of Small Cassette operation, on the occurrence of the 72nd clock pulse accumulated in the Program Counter; thus the timing designation for this event would be CT 72P—SQ3/SC.

Fuser Operation in Base Mode

Figures 3, 3B, 15:
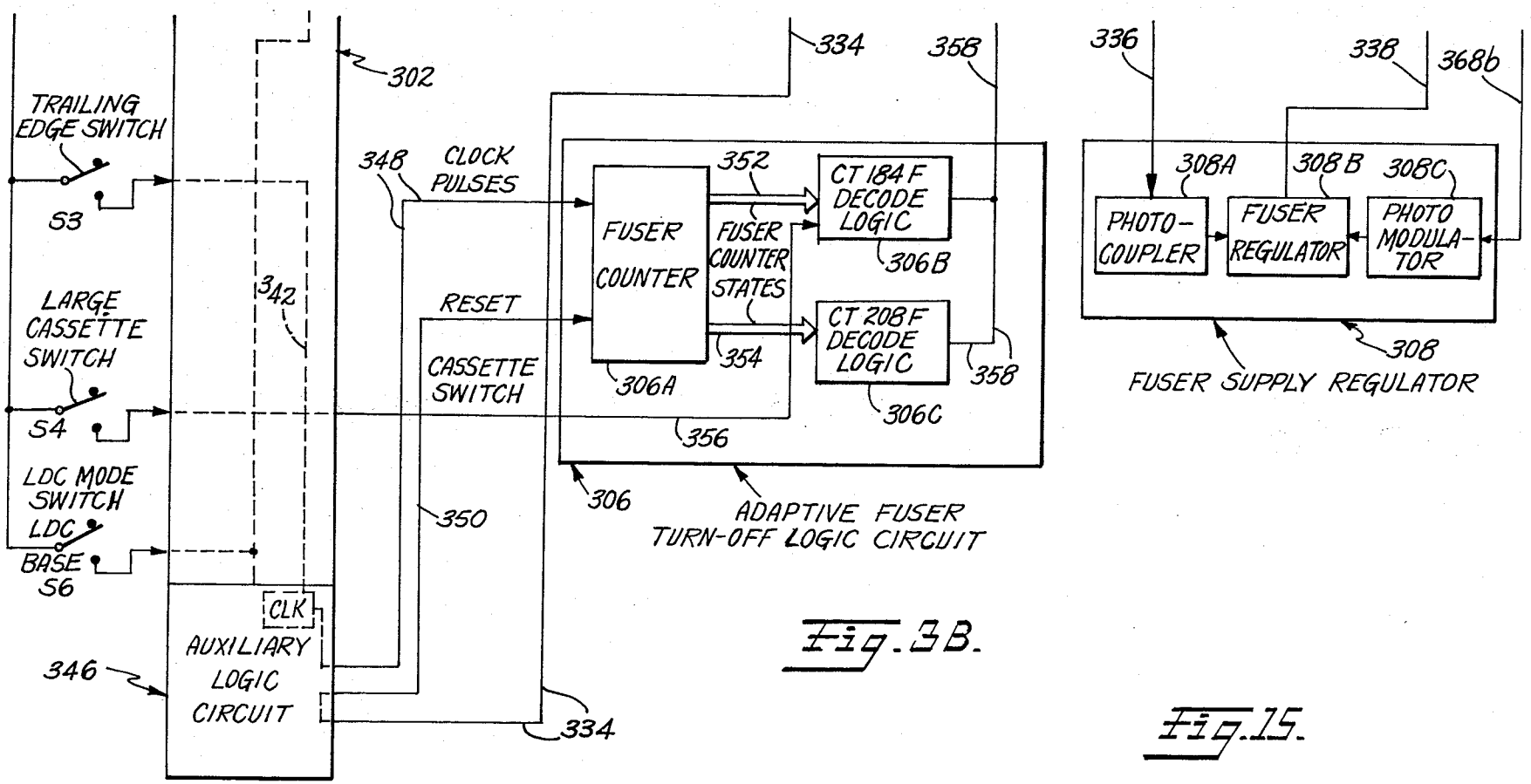

The timing diagram of FIG. 4 particularly depicts the fuser related sequences and is described below in reference to FIG. 3.

In the BASE Mode of copier/duplicator operation, a copy sequence is initiated by pressing the Print Button (FIG. 2). Pressing the Print Button 53 initializes all the control logic, turns on the exposure lamp 21, energizes the FUSER ELEMENT 310 at low power and clears and starts the Master Counter 318. The low power fuser operation (SOFT Start-215 Watts) serves to bring the heating element up to temperature in advance of the time full fusing power is required and prevents power surges when full fuser power is needed. As may be seen by reference to FIG. 3, the low power fuser operation is controlled directly by the logic circuitry which energizes the exposure lamp (Base Exposure Latch) and therefore is activated whenever the exposure lamp is energized.

Subsequent to the initiation of a copy cycle, a number of xerographic processes are begun, as and when required, under the control of Master Counter 318. The time at which the next fuser function occurs is conditioned by the number of copies ordered, as set into the machine via the copy dial 99. Thus the BASE Mode may be operated in two distinct submodes, Single Copy Run and Multiple Copy Run. By referring to the Timing diagram of FIG. 4 the operation of two cases can best be illustrated.

Base Mode-Single Copy Run Case

In Single Copy Run, the fuser is turned on SOFT at the initiation of the copy cycle via the Base Exposure Latch at a master count of 0. The Master Counter proceeds to accumulate counts at the input clock rate, which may be 60 Hz, and at counts of 64 and 80, additional xerographic functions (charge and scanning respectively) are activated. Neither of these counts effect fuser operation. At CT 80M the Master Counter 318 is cleared, and is allowed to restart, conditioned by the operation of the Home Switch S1. The actuation of Switch S1 indicates that the optics scanning carriage has actually left its home position and is commencing to scan the original document being copied. The Master Counter 318 continues to increment, performs an additional xerographic control function at CT 8M-SQ2 (development), and proceeds until CT 141M-SQ2. At CT 141M-SQ2, a Coincidence Latch in the BASE LOGIC 300 is set to the high state which, in turn, controls a number of other logic elements in a manner as to initiate a unique series of steps. The Coincidence Signal (COINF) from the Coincidence Latch at CT 141M-SQ2 signifies that no additional copies are to be made which is always true for the Single Copy Run case. In General, coincidence occurs after charging is complete for the copy being processed.

On occurrence of the setting of the Coincidence Latch and CT 141M-SQ2, the Master Counter 318 is again cleared and restarted. The copier sequence shifts immediately from Sequence 2 directly into Sequence 4. The next fuser related function occurs when the Trailing Edge Switch S3 is deactuated by the trailing edge of the copy paper which starts the Fuser Counter 306A. However, since in BASE Mode, the maximum length of copy paper along the copy paper travel direction is 8.5 inches, the Trailing Edge Switch S3 is in fact actuated before full fuser turn-on is initiated. Thus, for small paper sizes (small cassette) the Fuser Counter 306A is reset to zero at CT 72M-SQ4 which is also the time full fuser power is applied. In such cases, the Fuser Counter 306A is not and need not be trailing edge dependent as the copy paper size is fixed and fuser turn-off is thus tied to fuser turn-on. Continuing, at CT 72M-SQ4, FUSER LATCH 332 is set, as the needed Coincidence signal is now present at CT 72 Decode Logic 304B. Setting the FUSER LATCH 332 causes full power turn-on of FUSER ELEMENT 310 as explained heretofore. The fuser full turn-on at CT 72M-SQ4 coincides with the copy paper leading edge having arrived nominally ½ second away from the centerline of FUSING ELEMENT 310. The fusing of the toner image then proceeds as the copy paper progresses within the fusing station. SOFT power to the Fuser is essentially overridden by Full fuser power.

The final fuser function required, the turn-off, is initiated after the Fuser Counter has accumulated 184 counts (CT 184F). At CT 184F the FUSER LATCH 332 is reset to the low state causing the FUSER ELEMENT 310 to be deenergized. The Master Counter continues running independently of the Fuser Counter and Sequence 5 of the Master Counter governs machine cycle-out and shutdown.

Base Mode-Multiple Copy Run Case

In Multiple Copy Run the FUSER ELEMENT 310 is turned on SOFT at the initiation of the copy cycle via the Base Exposure Latch in the Base Logic at CT 0M-SQ1. The fuser operation as well as all other copier/duplicator steps are identical to those of the Single Copy Run as previously described, up to CT 141M-SQ2.

At CT 141M-SQ2, due to the absence of a Coincidence signal from the Coincidence Latch, Master Counter 318 continues counting within Sequence 2 and continues into Sequence 3. At CT 152M-SQ3, the FUSER LATCH 332 is set to the high state causing the FUSER ELEMENT 310 to be turned on at full power. The logical conditions for the CT 152M Decode Logic 304C are satisfied as the Coincidence signal gets inverted in the Decode Logic 304C (thus no coincidence) and the Development Latch was set at CT 8M-SQ2. Here, however, fuser turn-on corresponds to the copy paper leading edge being nominally 1½ seconds away from the fusing element centerline. As before, on arrival of the copy paper, fusing of the transferred image proceeds as the copy paper progresses through the fusing station.

Note that once energized, the FUSER ELEMENT 310 remains full-on during Multiple Copy Run operation. This is shown in FIG. 4 by reference to the repetitive nature of Sequence 3. At CT 141M-SQ3, if the Coincidence Latch is not set, the Master Counter 318 continues on to CT 176M-SQ3 which is functionally equivalent to resuming copier/duplicator operation at the previously shown CT 176M-SQ3. Thus, in the absence of a Coincident signal at CT 141M-SQ3, the copier/duplicator continues in this repetitive mode until the required number of copies have been made and the Coincidence Latch is set. Maintaining the fuser full-on during the multiple copy run automatically eliminates any electrical surge problems.

On occurrence of the setting of the Coincidence Latch, the copier/duplicator terminates Sequence 3 at CT 141-SQ3 and Sequence 4 is initiated. Sequence 4, with the exception of fuser turn-on is identical to and applicable to both the Single Copy Run and the last copy of a Multiple Copy Run. Therefore, after the entrance into Sequence 4, fuser turn-off is accomplished identically as previously described under Single Copy Run. Briefly, fuser turn-off is conditioned by the operation of the Trailing Edge Switch which starts the Fuser Counter. The Fuser Counter is reset at CT 72M-SQ4 and at CT 184F, the Fuser Latch is reset to the low state causing the FUSER ELEMENT 310 to be deenergized.

Resuming where The Master Counter had reached CT 157M-SQ4, note that the Master Counter continues to increment normally until CT 256M-SQ5. In the preferred embodiment, the Master Counter comprises an 8 bit ripple counter which becomes full, at 256 counts and an additional 8 bit counter, the Program Counter 316, is connected in series with it, thus allowing extended capacity. Program Counter 316 is used for alternate functions in other modes of the copier. For present purposes, it is merely an extension to the Master Counter capacity, and at CT 1024M-SQ5 the copier is powered down.

Fuser Operation in LDC Mode

In the LDC Mode of copier/duplicator operation, a copy sequence is initiated by operation of one or both of the Document Switches, which sense the insertion of an original document to be copied. It should be noted that the LDC Mode embodies two distinct operating submodes, both of which are single copy modes of operation. These are designated Large Cassette (LC) and Small Cassette (SC) Cases. In the Large Cassette Case, the copier/duplicator has a paper size capability of up to 18 × 14 inches. The Small Cassette Case embodies an operating mode wherein a number of copies can be chain-fed in rapid sequence. In the chain-feeding Submode, copy paper size is limited to 8½ × 11 inches. The Timing diagrams of FIGS. 5A and 5B show the fuser related sequences pertinent to the LDC Modes as described below with continued reference to FIG. 3.

LDC Mode - Large Cassette Case

In the LDC/LC Case, Sequence 1 designates the initialization time period which is started by the activation of the Home Switch S1 after lever 31 has been moved in a clockwise direction. Alternately, if the copier/duplicator is already set in the LDC Mode (end of scan position reached and machine has cycled out to a stand-by condition), the actuation of the Print button 53 starts the initialization sequence to reset all of the control logic.

Sequence 2 is started upon activation of the Document Switches S7 and/or S8 which sense the presence of the original document. At this time, the Master Counter 318 is reset.

The fuser element is turned on SOFT at CT 16M-SQ2 via the LDC Exposure Latch. Since it is particularly important to avoid current surges associated with a zero to full power fuser turn-on, the fuser SOFT turn-on is initiated with the exposure function (at CT 16M-SQ2) to insure that electrical surges will not occur during exposure, development and transfer operations. At CT 72MSQ3/LC the Fuser Latch is set to the high state causing the FUSER ELEMENT 310 to be turned on at full power. This count also enables the Fuser Counter 306A to begin counting upon deactuation of the Trailing Edge Switch S3. It is noted here, that for large documents, the trailing edge of the copy paper will deactuate the Fuser Counter 306A after full power to the fuser has been applied (after CT 72M-SQ3). Thus, the Fuser Counter 306A is not reset after being initially started by the Trailing Edge Switch S3. In this sense, the fuser turn-off function is tied directly to copy paper size and is trailing edge dependent. This insures that variable lengths of large documents (greater than 10 inches for example the distance between Switch S3 and proximate fuser centerline) will turn off the fuser at the same relative position of the fuser centerline and copy paper trailing edge. The Trailing Edge Switch will generally occur somewhere in Sequence 4 and it serves to start the Fuser Counter as well as turn off charge and development. (It is noted that Exposure goes off as the Document Switches detect completion of document feeding). At CT 208F the FUSER LATCH 332 is reset to the low state causing the FUSER ELEMENT 310 to be deenergized. Note that at the second CT 13M of Sequence 3, the sequence is terminated and Sequence 4 is immediately entered. Further, the eight bit Master Counter is here augmented by the Program Counter to form an extended Master Counter which proceeds to CT 1536M-SQ4/LC at which time the copier/duplicator is powered down.

LDC Mode - Small Cassette Case

IN LDC/SC Case the fuser is turned on SOFT as in LDC/LC Case at CT 16M-SQ2. Since all LDC Modes ae single copy modes, coincidence is set at CT 141-SQ2. At CT 72M-SQ3/SC (CT 72P) the FUSER LATCH 332 is set to the high state causing the FUSER ELEMENT 310 to be turned on at full power. This count also resets the Fuser Counter 306A, which had been previously actuated by the Trailing Edge Switch as in the BASE Mode. At CT 184F the FUSER LATCH 332 is reset to the low state causing the FUSER ELEMENT 310 to be deenergized.

The chain feed option is available in the LDC/SC Mode and is implemented by resetting and clocking the Master Counter and Program Counter to run in parallel at coincidence (CT 141M-SQ2). A second document original may be fed into the document feeding means 30 any time after the first exposure terminates at CT 13M-SQ3 (CT13P). If a second document is fed into the machine in sequence 3 (as sensed by Document Switches S7 and/or S8) the Master Counter 318 automatically resets and begins at CT 0M-SQ2 as shown in FIG. 5B. The Program Counter tracks the first copy through sequence 3 while the master copy tracks the second copy through sequence 1.

Electrical surge problems are not too important in the Chain Feeding Mode (except for the first copy) as the FUSER ELEMENT 310 does not have time to cool sufficiently between copies, and no large current surges in fact take place. Inasmuch that any electrical surges would reduce copy quality because of simultaneous exposure and fuser turn-on, the problem is completely eliminated in coupling the SOFT Start feature to the document exposure. Thus if exposure of the second document (CT 16M-SQ2) begins before CT 72P, the SOFT Start, low power condition is operative. This situation is shown in "Chain Feed" timing graphs of FIG. 5B. If exposure of the second document (CT 16M-SQ2) takes place after 72P then power surges at full fuser turn-on (0 to 1150 watts) will not affect copy quality as exposure occurs after any surge.

As before, on completion of Sequence 3/SC by the Master Counter, the Master Counter is extended by the addition of the Program Counter. The presence of the small cassette conditions the Sequence 4/SC to be initiated, and at CT 1024M-SQ4/SC the copier/duplicator is powered down.

c. Detailed Logic Description

General

Figure 13:
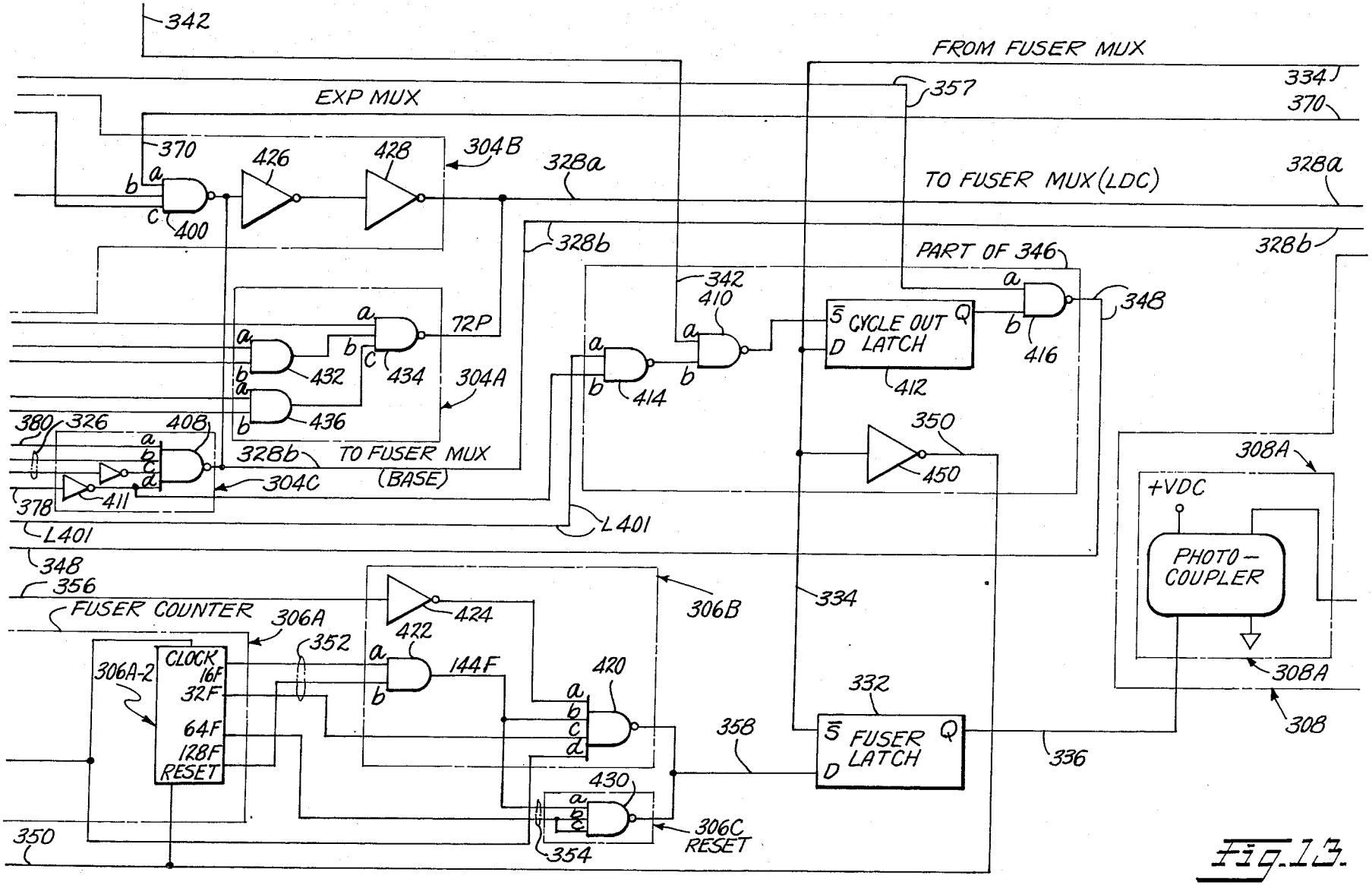
Figure 14:
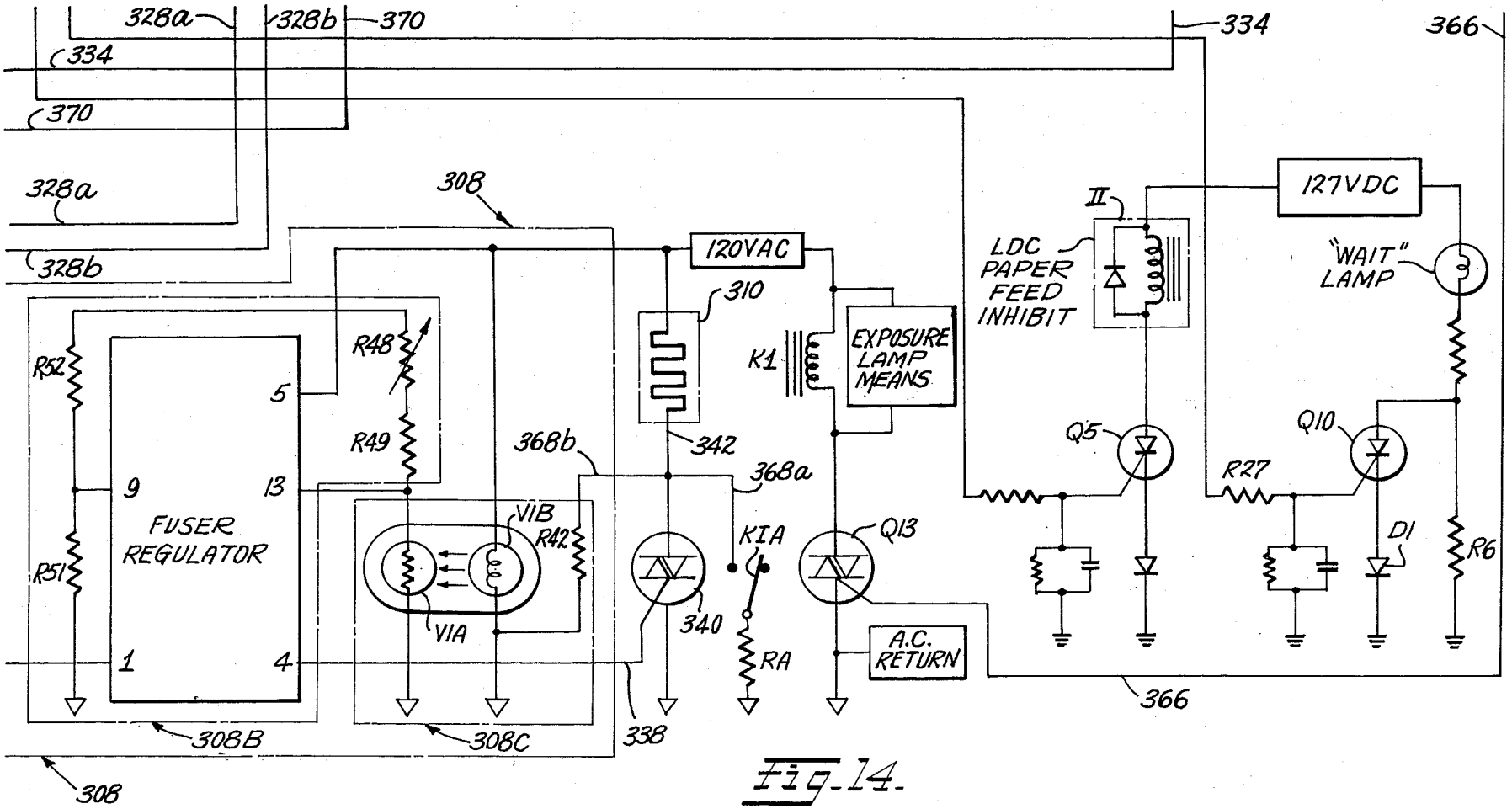

A detailed description of the LDC LOGIC 302 of FIGS. 6–11 is found in copending application Ser. No. 528,163 filed Nov. 29, 1974 (D/73383C). The description set forth below emphasizes those features of the multi-mode copier electronics which are particularly germane to the Adaptive Fuser Control Circuit (FIGS. 12–14) of the instant invention.

In describing the Adaptive Fuser Control Circuit and the LDC Logic, reference is made to the following tables wherein input and output connections are described.

TABLE 2

| INPUTS LINES FROM BASE LOGIC TO LDC LOGIC (See FIGS. 6 and 9) | |
|---|---|
| $\overline{\text{FD}}$ [LD1] | This input provides the status of jam (or failure) detecting means located in the BASE LOGIC; it inhibits continued copier operation when activated. In the absence of a jam (or failure) condition this line exhibits a logical "1". |
| $\overline{\text{DEVF}}$ [LD2] | This input provides the status of the Develop Latch located in the BASE LOGIC; it exhibits a logical "0" to enable the developing means through multiplexer 122M. |
| $\overline{\text{MAIN DRIVE}}$ [LD3] | This input provides the status of the Main Drive Latch (not shown) in the BASE LOGIC; it exhibits a logical high when the main drive M is not running and logical "0" when it is running. |
| SCAN [LD4] | This input from the BASE LOGIC provides a Scan Signal to the Scan Solenoid Mux 124M in the BASE Mode of operation. It is a logical "1" when the scanning means in the BASE Mode is operating. |
| EXPOF [LD5] | This input provides the status of the BASE Expose Latch located in the BASE LOGIC. It exhibits a logical "1" when enabling the exposure means. |
| PAPSW LD6] | This input provides the status of the paper sensing switch. When sufficient copy paper is present it exhibits a logical "1". |
| PRINT [LD7] | This input provides the status of the PRINT Button 53 to the multiplexer 123M. During actuation of the PRINT Button 53 it exhibits a logical "0". |
| CT 13M, 4M, 8M, etc. [LD9, LD11, LD13] | This input refers to count signals corresponding to 13, 4, 8, etc. of the master counter, provided in the form of a logical "1" via leads LD9, LD11 and LD13 respectively. |
| DEVF [LD10] | This input provides the status of the Develop Latch located in the BASE LOGIC. It is the inverse of DEVF mentioned above; thus when developer C actuating signals are provided by the Development Latch this goes to a logic "1" or high from logical "0". |
| HOME SW [LD12] | This input provides the status of the Home Switch S1. In the actuated state, i.e., when the scanning elements 21–22 are at the home position, it exhibits a logical signal "1". |
| $\overline{\text{HOME SW}}$ [LD14] | This input provides the status of the Home Switch S1. It is the inverse of the above i.e., when the scanning elements 21–22 have left the home position the Home Switch S1 is deactivated thereby providing a logical "1" signal via this line. |
| $\overline{\text{INITIAL}}$ [LD15] | This input provides the initializing signals developed in the BASE LOGIC. When $\overline{\text{INITIAL}}$ level is a logical "0", a power up sequence is occurring and this signal is used to initialize the elements contained in the LDC LOGIC. |
| CHARGEF [LD16] | This input provides the status of the Charge Latch located in the BASE LOGIC. A logical "1" indicates the activation of the charging means E of the xerographic machine. |
| COINF.$\overline{\text{DEVF}}$. MPX [LD17] | This input provides the composite status of the two named latches. It exhibits a logical "1" when the Coincidence Latch (COINF) is set and Development Latch ($\overline{\text{DEVF}}$) is not set. Both are located in the BASE LOGIC. |
| PROG CLK [LD18] | This input provides a signal associated with the incrementing of the Program Counter. It exhibits a logical "1" when the counter is being incremented; and reverts to a logical "0" upon termination of |

TABLE 2-continued

| INPUTS LINES FROM BASE LOGIC TO LDC LOGIC (See FIGS. 6 and 9) | |
|---|---|
| | each incrementing signal. The Program Counter is used to keep track of the number of copies made in a multiple copy, BASE Mode run and is incremented at CT 141M-SQ2. |

TABLE 3

| OUTPUT LINES FROM LDC LOGIC (See FIGS. 8 and 11) | |
|---|---|
| ADD PAPER [00] | This output is applied to the ADD PAPER indicator to advise as to a copy paper supply run out condition. |
| $\overline{\text{COINF SET}}$ [01] | This output is applied to the Base Logic, when it goes to logical "0" it sets the Coincidence latch in the Base Logic. |
| LDC BILLING [02] | This output signal is applied to an LDC building meter, the details of which are shown in the above-mentioned copending application, Serial No. 393,545. |
| EXPOF MPX (PRINT DISABLE) [161] | This output from the multiplexer 121M is used to actuate or energize the exposure means when the document original being scanned must be image exposed on to a photoreceptor. This signal also disables the PRINT button in the BASE Mode oper ation. |
| $\overline{\text{DEVF-MPX}}$ [162] | This output from the multiplexer 122M controls the developing means. With $\overline{\text{DEVF MPX}}$ of logical "1" the developing means is not on and when it switches to logical "0", the developing means is turned on. |
| $\overline{\text{LDC}}$ DEV BIAS $\overline{\text{RESET}}$ MPX [163] | This output from the multiplexer 123M is applied to the Bias Latch (not shown) of the machine and provides a normal bias level. |
| SCAN MPX [164] | This output from the multiplexer 124M is used to selectively energize the scanning means in the machine. |
| $\overline{\text{DONE-L}}$ [04] | This output signal signifies that the machine has completed a copy cycle while operating in LDC Mode. It is fed to the Base Exposure Latch in BASE LOGIC 300. |
| $\overline{\text{EXP MPX}}$ [165] | This output signal is applied to the exposure means to selectively maintain it in a non-actuated state. It is also applied to the Base input of multiplexer 121M. |
| MAIN DRIVE MPX [166] | This output from the multiplexer 125M is used to enable the main drive M. |
| FUSER MPX [167] | This output from the multiplexer 127M is applied to the Fuser Latch to selectively energize the fuser elements. |
| CHARGE MPX [168] | This output from the multiplexer 128M is applied to the charging means to selectively energize the charge corotron. |
| $\overline{\text{LDC}}$ [07] | This output signifies the operating mode of the machine, it exhibits a logical "0" to denote LDC operation. |
| $\overline{\text{LDC}}$ $\overline{\text{EXPOF}}$ [08] | This output, when a logical "0", resets the BASE Mode Exposure Latch which normally controls the jam detection timing. Since the jam detection requirements of the LDC Mode are different from the BASE Mode, the Exposure Latch must be reset. |
| DEV SET LDC [09 | This output, when a logical 0, sets the developer latch at the proper time in the LDC Mode, since this time is different than the time required for the BASE Mode. The BASE Mode signal is inhibited by the $\overline{\text{LDC}}$ output which is logical "0" when the machine is in the LDC Mode. |
| LDC 16 + COIN RESET [010] | This output when a logical "0", resets the Coincidence Latch at a count of 13 and DONE signifying that the machine is not processing a piece of copy paper. This output is used to set the COINF latch to logical "1", thereby cycling out the machine if copy is not started. |
| $\overline{\text{LDC}}$ $\overline{\text{MASTER}}$ $\overline{\text{CTR CLR}}$ | This output, when logical "1", signifies that the Master Counter is conditioned to count and when |

TABLE 3-continued

| OUTPUT LINES FROM LDC LOGIC (See FIGS. 8 and 11) | |
|---|---|
| [012] | logical "0", the counter is cleared and held at a count of zero. |
| $\overline{\text{HOME}}$ + $\overline{\text{LDC}}$ [013] and | These signals are actually LDC (the complement of $\overline{\text{LDC}}$). They perform the function of disabling the HOME Switch LATCH (Not Shown) while in the LDC Mode and simulating a power initialize pulse when the machine is changed from the BASE Mode to the LDC Mode. |
| PWR $\overline{\text{INIT}}$ +$\overline{\text{LDC}}$ [014] | |
| 141 DISABLE [015] | This signal, when a logical "0", disables a jam the 60Hz clock signal to the Program Clock Latch once coincidence has been set. |
| LDC EXT SHUT DN [016] | This signal, when a logical "0" is used to power-down the machine in the LDC/LC mode. The output provided represents a timing count in the Master Counter/Program Counter which extends the shutdown time (e.g., 26 seconds) from a shorter shutdown (e.g., 16 seconds) used in the BASE Mode. |

TABLE 4

| SIGNAL EXCHANGE BETWEEN LDC LOGIC AND FUSER CONTROLLER (See FIGS 6–14) | |
|---|---|
| TRAILING EDGE SWITCH SIGNAL [342] | This input signal provides the status of the TRAILING EDGE SWITCH S3 to Auxiliary Control Circuit 346. It provides a logical "0" when copy paper is present at its location; a logical "1" when no paper is present. In combination with AUXILIARY LOGIC 346, it enables Clock Pulses to be routed to FUSER COUNTER 306A. |
| LDC FUSER TURN-ON [328a] | This output provides the fuser turn-on signal for LDC MODE operation. It transitions to a logical "0" on the occurrence of the proper counter states and is used to set the FUSER LATCH 332 via Fuser Mux 127M. |
| BASE FUSER TURN ON [328b] | This output provides the fuser turn-on signal for BASE Mode Operation. It transitions to a logical "0" on occurrence of the proper counter states and is used to set the FUSER LATCH 332 through Fuser Mux 127M. |
| EXP MUX [370] | This input signal provides the status of the Expose Latches (both BASE & LDC) to CT 72M DECODE LOGIC 304B. It supplies a logical "1" to denote that the appropriate Expose Latch is set to the high logic level. |
| FUSER MUX [334] | This input line provides the selected fuser turn-on signal as developed on output lines 328a and 328b above, via Fuser Mux 127M. It is a logical "0" level used to set FUSER LATCH 332. |
| COINF [374] | This input signal provides the status of the Coincidence Latch to TURN-ON LOGIC 304. When no further copies are to be made, it provides a logical "1" via a line 374. |

With regard to the fuser operation and FIGS. 6–11, the Fuser Mux 127M selects either a LDC FUSER signal or a BASE FUSER signal along its inputs A and B respectively. In the aforementioned copending application (D/73383C), the LDC FUSER signal originated from a FUSER LATCH which was triggered by the LDC EXPOSURE LATCH. In the instant invention, the LDC FUSER signal as well as the BASE FUSER signal are fed to Fuser Mux 127M via the Adaptive Fuser Circuit shown in FIGS. 12–14 and as explained in detail below. The prior FUSER LATCH has essentially been replaced by the Adaptive Fuser Circuit and several miscellaneous gates, namely, NAND gates 460 and 462 and inverting gates 464 and 466 (FIG. 10).

It is noted in FIGS. 6–11 that gate and circuit designates remain the same as those in the above mentioned copending application. Several simplifications have been made to the drawing, however for ease of understanding the instant Adaptive Fuser Circuit. In particular, only pull-up circuits 101A has been shown in detail although all such circuits 101A, B, C, etc., are identical. In addition, the multiplexers have been indicated in block form only as they are all identical to the multiplexer shown in detail in FIG. 16A. Finally, the latches are shown in block form and are all identical to the latch shown in detail in FIG. 16D; in most cases the memory reset signal (MR) has not been drawn.

Base Mode - Single Copy Run

In the BASE Mode, SOFT turn-on of the fuser is simultaneous with exposure. Thus, the EXPOF signal from BASE LOGIC 300 (line LD5) is inverted in inverting gate 299 and an $\overline{\text{EXPOF}}$ signal is fed to the B input terminal of Expose Mux 125M via line 362. The Expose Mux 125M and indeed all the multiplexers 121M–128M, are conditioned to select signals at the B input terminals thereof. The signal conditioning the multiplexers comes from the output of NAND gate 102 which has its *a* input fed by the LDC Mode Switch S6 (via pull-up circuit 101A) and its *b* input fed from the no-malfunction signal $\overline{\text{FD}}$ along line LD1. Thus, the output of NAND gate 102 is used as the "select" input to the multiplexers 121M–128M, and its output is high, logically 1, for the BASE Mode and low, logically 0, for the LDC Mode. Data Multiplexers 121M to 128M inclusive provide eight independent but identical switching functions. The labeling of "2:1 Mux" denotes that they provide the electronic equivalent of a conventional single-pole, double-throw switching action. One of the two inputs A or B is selected for presentation at its output in response to the "select" or conditioning input signal. The multiplexers may be of the type referenced in FIG. 16A. Note by reference to the truth table therein that no overall data inversion occurs as a result of the multiplexing and that the strobe input is hardwired in the enable condition. Thus, the $\overline{\text{EXPOF}}$ signal is provided at the output of Expose Mux 125M and this output signal is used to fire triac Q13 (FIG. 14) via line 366 a photocoupler U74 and inverting gates U67 and U71. With the firing of triac Q13 contacts K1A of relay K1 are connected to the FUSER ELEMENT 310 thus activating FUSER ELEMENT 310 at low power, completing SOFT turn-on.

Figure 12:
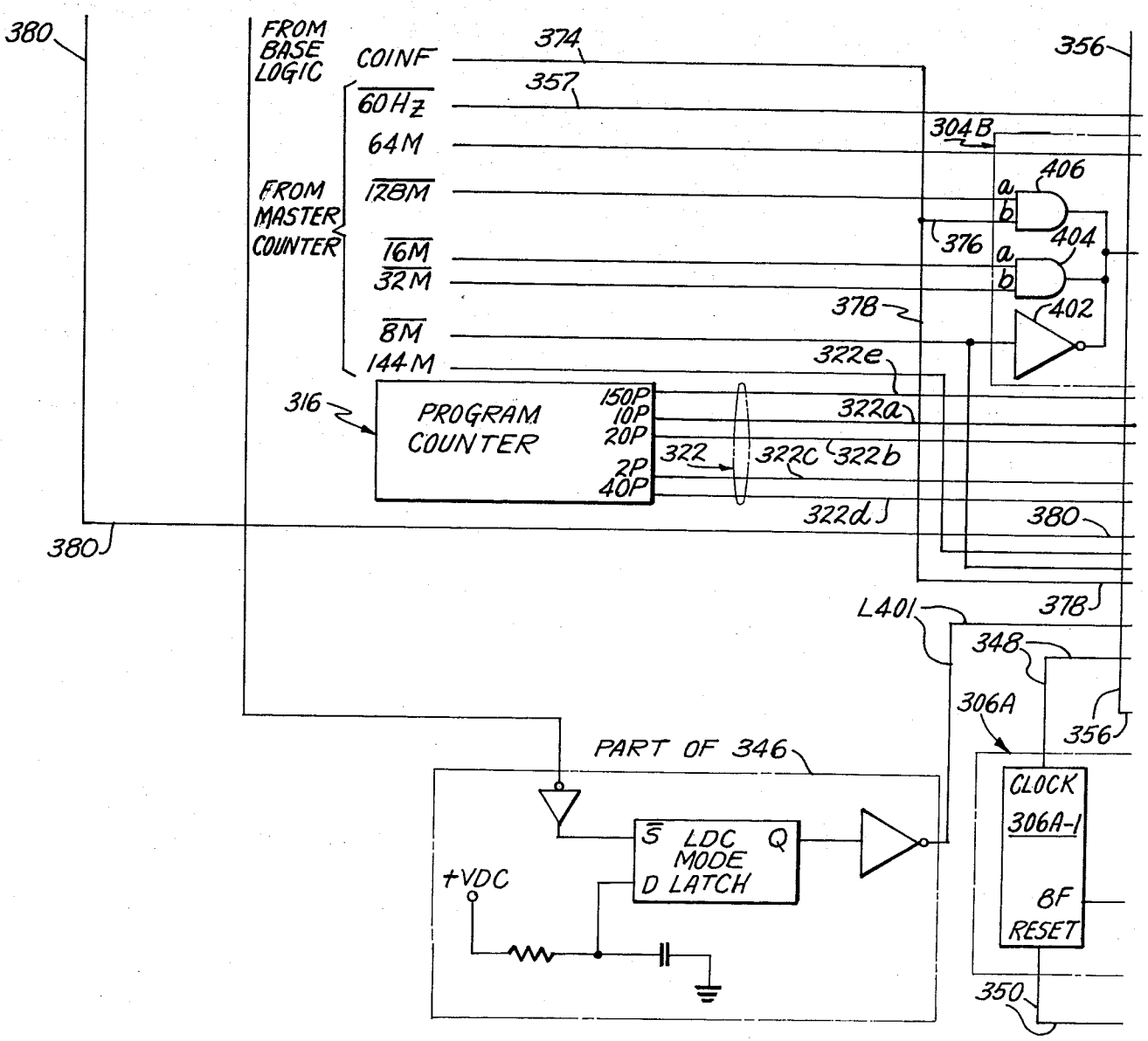

Full fuser turn-on occurs at CT 72-SQ4. Master Counter states are decoded in the CT 72M Decode Logic 304B which comprises appropriate gates and inverters. Specifically, Master Counter state 64 is applied to the *c* input of a NAND gate 400, (FIG. 13), and counter state 8 is applied to the *b* input of NAND gate 400 via inverting gate 402. Hence, NAND gate 400, when conditioned by a high level at its *a* input produces a low level at its output corresponding to count 72. The required high level to the *a* input is supplied in the form of the Expose Mux signal (EXP MUX) from the output of inverting gate U71 (FIG. 11) via line 370 denoting that the exposure lamp is being energized. Referring now to FIG. 12, and AND gate 404 is wired-anded with inverting gate 402 and has its two inputs fed by Master Counter states $\overline{16}$M and $\overline{32}$M, hence producing at its output a low level on occurrence of count 48M. This output is also applied to input *b* of NAND gate 400. The final conditioning input to NAND gate 400 is provided by the output of an AND gate 407. Input *a* of AND gate 406 is fed by counter state $\overline{128}$M; input *b* is the Coincidence signal (COINF) from BASE LOGIC 300 via lines 374 and 376. As described in Table 4, this Coincidence signal denotes the condition wherein no further copies are to be made. It originates in BASE LOGIC 300, is conditioned by the number of copies ordered by the operator on dial 99 and provides a logical 1 when the desired number of copies has been reached. In a Single Copy Run it transitions to logical 1 at a predetermined point in the copier/duplicator cycle (CT 141M-SQ2) and by providing the required high logic level to NAND gate 406 selects the CT 72M Decode Logic 304B to provide the fuser turn-on signal.

The logical 0 output from NAND gate 400 is routed via line **328*b* to the input of Fuser Mux 127M** where it is selected through to its output.

The output of Fuser Mux 127M is in turn applied to a Set input $\overline{S}$, of FUSER LATCH 332 via line 334 where it causes the latch to be set to the high state. (See FIG. 16D for details of the R/S Mode of latch operation. The logical 1 from the Q output of FUSER LATCH 332 is fed to the FUSER SUPPLY REGULATOR 308 which in turn fires Fuser Triac 340 along line 338.

The FUSER SUPPLY REGULATOR 308 provides two main features: (a) it provides DC/AC isolation between the low level DC control logic circuits and the high power AC fuser energizing circuits and (b) it provides a control circuit for maintaining a precise, constant, predetermined level of AC power through the FUSER ELEMENT 310. In particular, the Q output of FUSER LATCH 332 is routed to the input of Photocoupler 308A via line 336. In the set condition, the output of FUSER LATCH 332, a high logic level, energizes the photodiode element in the Photocoupler 308A thereby reducing the Photocoupler output resistance. The output of Photocoupler 308A is applied to an input gate terminal 1 of Fuser Regulator 308B. Fuser Regulator 308B (RCA 3059 or equivalent) comprises a zero crossing detector, and uses the photocoupler input signal to time modulate a 120 VAC source applied to its input terminal 5 and pass it along to an output terminal 4. Terminal 4 in turn is connected via line 338 to the control element of Fuser Triac 340. A plurality of resistors R48, R49, R51 and R52 form three legs of a DC bridge circuit, the fourth leg of which comprises the photosensitive resistor VIA. Resistor R48 provides initial bridge balancing means. Thereafter bridge balance/imbalance is provided by the photosensitive resistor VIA and the bridge condition is sensed by Fuser Regulator 308B at input terminals 9 and 13 which monitor the centerpoint of each of the two major branches of the bridge circuit. An incandescent lamp VIB (optically coupled to photosensitive resistor VIA) is connected in series with a resistor R42; both of which are connected in parallel with FUSER ELEMENT 310 across a 120 VAC power source. Thus the light intensity emitted by lamp VIB, which is precisely proportional to the RMS voltage across FUSER ELEMENT 310, is used as a control input of the DC bridge circuit. Short and medium term variations in the voltage across the FUSER ELEMENT 310 are reflected into the bridge balance condition and by virtue of the action of Fuser Regulator 308B are in turn reflected into time-modulation of the AC control signal provided to Fuser Triac 340. Thus, the time-modulated control signals for Triac 340 act in a manner and of proper phase so as to compensate for undesired variations, and FUSER ELEMENT 310 is thereby provided with a constant, predetermined level of power excitation.

When Fuser Triac 340 is conducting heavily, it provides a conducting path parallel to the Soft Start conduction path. The greatly lower impedance of Triac 340 when it is conducting, are compared to power resistor RA, provides the transistion from low power operation to the full power fuser ennergizing required to properly fuse the xerographic image to permanence. The other end of FUSER ELEMENT 310 is connected to a source of AC power of suitable current-carrying cpacity to provide the required fuser current levels. The return side of the AC line is shown as a separate series of connections for all of the circuitry directly associated with the high power AC coupling, controlling and switching.

BASE Mode - Multiple Copy Run

Multiple Copy Run operation is initiated by the operator ordering more than one copy to be made via the Copy Number Dial 99 shown in FIG. 1. As in the Single Copy Run case, the fuser turn-on is controlled by the Master Counter 318 and portions of the BASE LOGIC 300 and LDC LOGIC 302. SOFT Start is achieved in the same manner as described above for the Single Copy Run. Full fuser turn-on occurs at CT152M-SQ3.

On reaching the accumulated count of 152 in the Master Counter 318, FUSER LATCH 332 is set to the high state thereby energizing the FUSER ELEMENT 310 at full power in a manner identical to that described above.

Specifically, Master Counter states of 144M and 8M are applied to inputs *b* and *c* respectively of a NAND gate 408. In conjunction with further inputs, NAND gate 408 provides a low level (logical 0) on occurrence of count 152M. The other inputs include DEVF signal available via line 380 and a $\overline{\text{COINF}}$ signal from lines 374 and 378, and inverting gate 411. Due to the $\overline{\text{COINF}}$ signal, NAND gate 408 is disabled when the $\overline{\text{COINF}}$ signal is a high logic level (Single Copy case or last copy of Multiple Copy case), but is enabled when the $\overline{\text{COINF}}$ signal level is a low logic level (not last copy of Multiple Copy case). For fuser purposes, the application of the $\overline{\text{COINF}}$ signal to CT 72M Decode Logic and $\overline{\text{COINF}}$ signal to CT 152M Decode Logic is the principal means for determining which of the two circuits are operative in BASE Mode.

BASE Mode - Fuser Turn Off

In the BASE Mode, fuser turn-off is accomplished under the control of the Fuser Counter 306A. Full Fuser turn-off is timed so as to occur nearly simultaneously with the transit of the full sheet of copy paper past the centerline of the FUSER ELEMENT 310. The order of events therefore is as follows: (a) SOFT Start, (b) full fuser turn-on (and override of SOFT Start) and (c) full fuser turn-off.

Specifically the Trailing Edge signal is applied from Switch S3 and pull-up circuit 101E via line 343 to the *a* input of a NAND gate 410 whose output is tied to the Set input of a Cycle Out Latch 412. Inputs *a* and *b* to a NAND gate 414 are respectively LDC level via line L401 and the $\overline{\text{COINF}}$ signal from the output of inverting gate 411. The LDC level is high in the BASE mode as this signal comes from the LDC Mode Latch via an inverter. Thus, the $\overline{\text{COINF}}$ Signal, by exhibiting a low logic level only after the required number of copies have been made, inhibits the output of NAND gate 414 from being a high level at any point in the copy/duplicator cycle prior to that time. The output of NAND gate 414 is tied to the b input of NAND gate 410. However, immdiately after the $\overline{\text{COINF}}$ signal goes to a low logic level, the output of NAND gate 414 goes to a high logic level thereby enabling the Trailing Edge signal (when it occurs) through NAND gate 410 to set the Cycle Out Latch 412 to the high state thus providing the Enable Signal to clock 60 Hz into the Fuser Counter 306A.

The high state on the Cycle Out Latch is fed to the *b* input of a NAND gate 416 which has its *a* input fed by a source of clock pulses, 60Hz, via line 357. The output of NAND gate 416 is applied via line 348 to the input (counting) node of a Fuser Counter 306A consisting of two four-bit, ripple connected, binary counters 306A-1 and 306A-2. Thus, upon actuation of the Trailing Edge Switch causing the Cycle Out Latch 412 to be set, the Cycle OUt Latch Q ouput transitions to a logical 1 enabling the clock pulses to begin accumulating in Fuser Counter 306A.

The outputs of Fuser Counter 306A are fed to the Decode Logic Circuit 306B. A NAND gate 420 has its *c* and *d* inputs connected to Fuser Counter states of 32F and 8F respectively. An AND gate 422 has as its *a* and *b* inputs connected to Fuser Counter states 16F and 128F respectively. The output of AND gate 422, a signal representing counter state 144F, is applied to the *b* input of NAND gate 420. A Large Cassette Switch signal available via line 356, is applied to the input of inverting gate 424, and in turn to the *a* input of NAND gate 420.

In the Base Mode of copier/duplicator operation, only the use of a small paper cassette is permitted, therefore the Large Cassette Switch signal will be constant at logical 0 for present purposes. This logical 0 is inverted by inverting gate 424 and provides a logical 1 to NAND gate 420 input *a*. NAND gate 420 therefore decodes a counter state of 184F, which is applied to a D input of FUSER LATCH 332 via line 358. The negative going level from NAND gate 420 resets the FUSER LATCH 332 and its Q output reflects this by transitioning to a low logic level thereby inactivating the Photocoupler 308A. Complete deenergizing of FUSER ELEMENT 310 results.

For the BASE Mode, the size of the copy paper is fixed (8½ × 11 inches) and the positioning of the Trailing Edge Switch within the copier/duplicator is such that the trailing edge of the copy paper physically actuates the Trailing Edge Switch S3 before the fuser is turned on, e.g. before CT 72M-SQ4. However, in all such cases the Fuser Mux output signal along line 334 simultaneously sets the FUSER LATCH 332 (thereby turning the fuser full-on) and resets the Fuser Counter 306A via an inverter 450 and line 350. Thus, the Fuser Counter resets at CT 72M-SQ4 and begins counting from zero reaching the full fuser shut-off state at CT 184F as described above. For the BASE Mode, therefore, full fuser turn-off is set to occur a predetermined time (184F) after full fuser turn-on since, as the copy paper size is fixed, it is not necessary to condition fuser turn-off in relation to the copy paper size.

LDC Mode - Large Cassette Submode

After being cleared and inhibited during the initialization period (Sequence 1), the Master Counter 318 begins accumulating clock pulses at the input clock rate of 60 Hz. On reaching the CT 16M-SQ2, the FUSER ELEMENT 310 is turned on at low power (SOFT Start). A line LD20 provides a signal CT 16M to the input of inverting gate 247, and in turn a $\overline{\text{CT16M}}$ signal is supplied on line LD20a to the *b* input of NAND gate 246. The output of NAND gate 246, a logical 0, is applied directly to a Set input of the LDC Exposure Latch forcing it to the high state. A Q output of LDC Exposure Latch feeds the high logic level to an inverting gate 220 and thereafter directly to the A input terminal of the Expose Mux 125M as a low logic level designated $\overline{\text{LDC EXPOF}}$. The path for SOFT Start beyond Expose Mux 125M is identical to that outlined in the BASE Mode description above.

At the count of 72 of Master Counter 318 (CT 72M-SQ3), the FUSER ELEMENT 310 is energized at full power approximately 0.5 seconds before the leading edge of the copy paper reaches the centerline of the fuser station. The circuitry used is identical to that as described above for BASE Mode operation in Single Copy Run. Briefly summarizing: NAND gate 400, in combination with AND gates 404 and 406, inverting gate 402, plus the two conditioning logic levels provided by the Expose Mux signal on line 370 and the Coincidence signal on line 378, decodes the required CT72M. This signal is fed from NAND gate 400 to the input of an inverting gate 426, in turn out of inverting gate 426 and into a second inverting gate 428 and thereafter via line 328*a* to the A input of Fuser Mux 127M. The two inverting gates provide isolation between the CT72M Decode Logic and CT72P Decode Logic circuits; however, no overall logic level inversion occurs. Beyond the Fuser Mux 127M, the path for full FUSER ELEMENT 310 energizing is identical to that described above for all modes of copier/duplicator operation.

Fuser turn-off is initiated by actuation of the Trailing Edge Switch S3 which sets the Cycle Out Latch 412 via NAND gate 410 thereby enabling Fuser Counter 306A to begin accumulating 60 Hz clock pulses through NAND gate 416. The circuit path is identical to that for fuser turn-off in BASE Mode operation as described above up to the decoding circuits. With the Fuser Counter 306A accumulating 60 Hz clock pulses, fuser states 16F and 128F are applied to the *a* and *b* inputs respectively of AND gate 422. Thus the output of AND gate 422 will exhibit a high logic level beginning at the count of 144F; this output is directly connected to the *a* input of a NAND gate 430. Fuser Counter state 64F is connected to the *b* and *c* input of NAND gate 430 whose output will exhibit a low logic level on the accumulation of 208 clock pulses in Fuser Counter 306A. The output of NAND gate 430 is connected directly to the D input of FUSER LATCH 332. On the occurrence of the low logic level via NAND gate 430 output, corresponding to CT 208F, the FUSER LATCH 332 is unconditionally reset and its Q output transitions to a low logic level. This low logic level being insufficient to energize the Photocoupler 308A causes the FUSER ELEMENT 310 to be deenergized in a manner identically as described above for BASE Mode operation. Fuser Counter 306A also provides output states to NAND gate 420, which is configured to decode a count of 184F. However, in a Large Cassette Submode this decoding is inhibited by the presence of a low logic level on the *a* input of NAND gate 420 which is derived from the output of inverting gate 424 and in turn from the Large Cassette Switch S4 via line 356.

In the Large Cassette Submode, the Trailing Edge Switch S3 is activated by the trailing edge of the copy paper after full fuser turn-on is achieved. Thus, the fuser counter begins counting from zero (reset at CT72M-SQ3) at the occurrence of the Trailing Edge Signal from Switch S3. Since variable large copy paper sizes may be utilized in the Large Cassette Submode, it is necessary to trigger fuser turn-off upon the occurrence of the copy paper trailing edge. It is noted that in both BASE and LDC Modes the copy paper travel speed is the same, and a Fuser Counter state 208F for the LDC Mode places the copy paper in the same position relative to the fuser centerline as does CT 184F in the BASE Mode.

LDC Mode - Small Cassette Submode

In the Small Cassette Submode (8½ × 1 copy paper) fuser full turn-on is accomplished when the copy paper in use is approximately 0.5 seconds from the centerline of the fuser station. As described above in connection with Large Cassette operation, this occurs on the accumulation of 72 counts in a counter upon the counter being phased in Sequence 3 as shown in FIG. 5B. To accomodate the Chain Feeding capability in this submode the Program Counter 316, takes on a portion of the timing duties previously handled by the Master Counter 318. (A full description of the operation of the Chain Feeding Mode is contained in concurrently filed application of W. L. Valentine entitled "Chain Feed Control Logic for a Multi-Mode Copier/Duplicator".) It is the Program Counter 316 which provides the time base which is decoded to yield the required precise fuser turn-on time.

Program Counter 316 consists of a 4 bit decade counter cascade-connected to a 4 bit binary counter in which selected stages are available via a plurality of lines 322 to the CT72P Decode Logic 304A. Specifically, counts 10P and 20P are routed via lines 322*a* and 322*b* respectively to inputs *a* and *b* of an AND gate 432. The output of AND gate 432, a high logic level on occurrence of count 30, is applied to the "b" input of NAND gate 434. Counts 2 and 40 of Program Counter 316 are routed via lines 322*c* and 322*d* respectively to inputs *a* and *b* of an AND gate 436. The output of AND gate 436, a high logic level on occurrence of count 42, is applied to the *c* input of NAND gate 434. An additional output from Program Counter 316, a CT150P signal is routed via a line 322*e* to the *a* input of NAND gate 434. The output of NAND gate 434 therefore exhibits a low logic level on the accumulation of 72 counts in the Program Counter 316. This output, designated CT72P is routed via line 328*a* directly to the A input of Fuser Mux 127M. Beyond the Fuser Mux 127M the signal paths and circuitry required to energize the FUSER ELEMENT 310 at full power, are identical to those described above for BASE Mode, Single Copy Run operations. Fuser SOFT Start is implemented in this submode identically as described above for the Large Cassette Submode.

Fuser turn-off occurs substantially the same as described above for BASE Mode operation. As before, fuser turn-off occurs under control of the Fuser Counter 306A, conditioned by the Large Cassette Switch S4 signal to select the CT184F Decode Logic 306B and the Trailing Edge signal which initiates the counter enabling. As in BASE Mode the Fuser Counter 306A is reset at CT 72M-SQ3.

In the preferred embodiment of the invention the multiplexers 121M – 128M and the latches (Cycle Out Latch, LDC Expose Latch, etc.) are shown in detail in FIGS. 16A and 16D respectively. All latches are operated in the R/S Mode (reset - set) as shown by the truth table of FIG. 16D. It is apparent, however, that other logically equivalent circuits may be utilized. In addition, other modifications and improvements of the instant invention will be apparent to those skilled in the art, and the claims are intended to cover all such modifications and improvements which do not depart from the spirit and scope of the invention.

I claim:

1. An adaptive control circuit for a fuser in a photocopy machine comprising:

circuit means for initiating a copy cycle;

a soft turn-on circuit responsive to said initiating circuit means to actuate said fuser to less than full power operating requirements for proper toner fixation on copy sheets passing thereby; and a full power turn-on circuit for fully activating said fuser for proper toner fixation at a selected time in said copying cycle.

2. An adaptive control circuit for a fuser in a photocopy machine having a plurality of modes of operation comprising:

a. a soft turn-on circuit responsive to a first machine condition to actuate said fuser to less than full power operating requirements for proper toner fixation on copy sheets passing thereby; and b. a full power turn-on circuit for fully actuating said fuser for proper toner fixation at a selected time in a machine cycle, said full power turn-on circuit being responsive to the particular mode of operation of said photocopy machine and the selected time for a full power turn-on corresponding to a particular mode of operation;

c. whereby current surges of said fuser are maintained sufficiently low upon application of said full power turn-on to substantially eliminate copy quality degredation.

3. An adaptive control circuit as recited in claim 2 wherein said photocopy machine has a large document copying mode of operation.

4. An adaptive control circuit as recited in claim 2 wherein said photocopy machine has a chain feeding mode of operation.

5. An adaptive control circuit as recited in claim 2 wherein said photocopy machine has a multiple copy mode of operation.

6. An adaptive control circuit as recited in claim 2 wherein said photocopy machine has a large document copying mode of operation and chain feeding mode of operation.

7. An adaptive control circuit as recited in claim 2 wherein said soft turn-on circuit is responsive to the particular mode of operation of said photocopy machine and the selected time for a soft turn-on corresponds to the particular mode of operation.

8. An adaptive control circuit as recited in claim 2 wherein said circuit further comprises a full power turn-off circuit responsive to the particular mode of operation of said photocopy machine.

9. An adaptive control circuit as recited in claim 8 wherein said photocopy machine comprises:

a. trailing edge sensor means responsive to the trailing edge of said copy sheet for providing trailing edge signals, and b. said turn-off circuit of said adaptive control circuit is actuated by said trailing edge signals in at least one mode of operation of said photocopy machine c. whereby, variable copy sheet sizes serve to turn off said fuser at substantially the same relative position of said copy sheet and fuser in said one mode of operation of said photocopy machine.

10. An adaptive control circuit as recited in claim 9 wherein said one mode of operation is a large document copying mode.

11. An adaptive control circuit as recited in claim 10 wherein said turn off circuit comprises a fuser counter and first decode logic means connected to said fuser counter for turning off said fuser at a predetermined count of said fuser counter, said fuser counter actuated by said trailing edge signals.

12. An adaptive control circuit as recited in claim 11 wherein said photocopy machine has a second, base mode of operation wherein said turn-off circuit is operative at a fixed timed in relation to the actuation of said full power turn-on circuit.

13. An adaptive control circuit as recited in claim 12 wherein said fixed time corresponds to a second predetermined count of said fuser counter and said turn-off circuit further comprises second decode logic means connected to said fuser counter for turning off said fuser at said second predetermined count.

14. An adaptive control circuit as recited in claim 2 wherein said soft turn-on circuit is responsive to the actuation of exposure means.

15. An adaptive control circuit as recited in claim 2 wherein said photocopy machine comprises first counter means for controlling photocopy machine functions, including said soft turn-on circuit and a second counter means for controlling said full power turn-on circuit independently of said first counter means.

16. A control circuit for a fuser in a photocopy machine having a large document copying mode of operation and a base of operation, said control circuit comprising:

a. full power turn-on circuit means for turning on said fuser at a predetermined time in a cycle of operation of said machine to thereby properly fuse a copy sheet image, b. turn-off circuit means responsive to the mode of operation of said photocopy machine, c. said turn-off circuit comprising:

i. fuser counter means, ii. first decode logic means coupled to said fuser counter means for turning off said fuser in said base mode of operation, and iii. second decode logic means coupled to said fuser counter means for turning off said fuser in said large document copying mode of operation.

17. A control circuit as recited in claim 16 wherein said photocopy machine is a xerographic copier having charging means, exposure means, development means and image transfer means controlled by a master counter and wherein:

said fuser counter is controlled by a predetermined state of said master counter in said base mode of operation, and said fuser counter is controlled by the trailing edge of copy paper in the large document copying mode of operation.

18. A control circuit as recited in claim 17 wherein said photocopy machine has a chain feeding mode of operation and a program counter, and said fuser counter is controlled by a predetermined state of said program counter in said chain feeding mode of operation.

19. A control circuit as recited in claim 16 wherein said photocopy machine further comprises:

a moving optical system for scanning documents in said base mode of operation, a fixed optical system for operation in said large document copying mode of operation, a document feeding means for moving a document relative to said fixed optical system in said large document copying mode of operation, document sensing means actuated by a document for sensing said document, and said full power turn-on circuit means operative at a substantially fixed time after actuation of said document means in said large document copying mode of operation.

20. A control circuit as recited in claim 19 further comprising a low power fuser turn-on circuit connected to said fuser but having insufficient power to properly fuse copy paper images, yet sufficient power to substantially reduce voltage and current surges upon application of full fuser power by said full power turn-on circuit means, and means for actuating said low power fuser turn-on circuit before actuation of said full power turn-on circuit means in said base mode of operation.

21. A control circuit as recited in claim 30 further comprising means for actuating said low power fuser turn-on circuit in said large document copying mode of operation.

22. A control circuit as recited in claim 21 wherein said low power fuser turn-on circuit is actuated before said full power turn-on circuit means is actuated whereby electrical surges in said large document copying mode of operation are substantially reduced.

23. A method of substantially reducing electrical surges to the fuser element of the fusing station in a photocopying machine having a plurality of modes of operation comprising the steps of:

applying a first voltage to said fusing element before a copy sheet enters the fusing station, said first voltage being insufficient to achieve toner fixing;

automatically determining which operating mode is being employed; and after applying said first voltage, applying a second voltage to said fusing element at different predetermined times depending upon which mode of operation is being employed, said second voltage being sufficient to achieve fixing of toner on said copy sheet in said fusing station, said first voltage being sufficiently close in magnitude to said second voltage to substantially eliminate copy quality degradation from electrical surges upon application of said second voltage to said fusing element.

24. A method as recited in claim 23 further comprising the step of removing said second voltage from said fusing element after a time interval dependent upon the length of copy paper employed.

25. A method of controlling the fuser in a large document copying photocopy machine with variable sized large document copying capabilities to effect fuser turn-off at substantially the same relative position of the fuser and copy sheet comprising the steps of:

transporting said copy sheet at approximately the same speed through said photocopy machine for said variable sized documents employed;

sensing the trailing edge of said copy sheet at a predetermined position in said photocopy machine, said position being upstream of said fuser station; and the activating of said fuser at a predetermined time after sensing said trailing edge of said copy sheet said deactivating step including the steps of:

enabling fuser counter means after sensing the trailing edge of said copy sheet; and sensing a predetermined state of said fuser counter means whereby said fuser is deactivated at the predetermined state of said fuser counter means.

* * * * *